US010463565B2

(12) United States Patent
Lowe et al.

(10) Patent No.: US 10,463,565 B2
(45) Date of Patent: Nov. 5, 2019

(54) ADJUSTABLE PATIENT THERAPY DEVICE

(75) Inventors: Mark H. Lowe, Danville, CA (US); Tamara L. Schirrmacher, Alameda, CA (US)

(73) Assignee: Coolsystems, Inc., Concord, CA (US)

( * ) Notice: Subject to any disclaimer, the term of this patent is extended or adjusted under 35 U.S.C. 154(b) by 1324 days.

(21) Appl. No.: 13/525,701

(22) Filed: Jun. 18, 2012

(65) Prior Publication Data

US 2013/0012847 A1 Jan. 10, 2013

Related U.S. Application Data

(60) Provisional application No. 61/498,419, filed on Jun. 17, 2011.

(51) Int. Cl.
*A61H 9/00* (2006.01)

(52) U.S. Cl.
CPC ... *A61H 9/0092* (2013.01); *A61H 2201/0192* (2013.01); *A61H 2201/0207* (2013.01); *A61H 2201/0214* (2013.01); *A61H 2201/0242* (2013.01); *A61H 2201/50* (2013.01); *A61H 2205/02* (2013.01); *A61H 2205/04* (2013.01); *A61H 2205/06* (2013.01); *A61H 2205/08* (2013.01); *A61H 2205/10* (2013.01); *A61H 2205/102* (2013.01); *A61H 2205/12* (2013.01)

(58) Field of Classification Search
CPC ..... A61H 9/0092; A61H 9/0078; A61H 9/00; A61H 9/005; A61F 5/012; A61F 5/013; A61F 5/34; A61F 5/37
USPC ..... 602/12–14; 2/336–342, 265, 269, 270
See application file for complete search history.

(56) References Cited

U.S. PATENT DOCUMENTS

| | | | |
|---|---|---|---|
| 1,886,768 | A | 11/1932 | Watson |
| 1,958,899 | A | 5/1934 | MacAdams |
| 2,146,622 | A | 2/1939 | Carlo |
| 2,148,661 | A | 2/1939 | Thierer |
| 2,413,386 | A | 12/1946 | Schulz |
| 2,510,125 | A | 6/1950 | Meakin |

(Continued)

FOREIGN PATENT DOCUMENTS

| | | | |
|---|---|---|---|
| CN | 2304378 | Y | 1/1999 |
| CN | 1373649 | A | 10/2002 |

(Continued)

OTHER PUBLICATIONS

"Patient Guide to UCL Injuries of the Elbow (Ulnar Collateral Ligament". Johns Hopkins Medicine Orthopaedic Surgery. https://web.archive.org/web/20100903163132/http:/www.hopkinsortho.org/ucl.html. Published on Sep. 3, 2010. Retrieved on Apr. 20, 2015.*

(Continued)

*Primary Examiner* — Rachel T Sippel
(74) *Attorney, Agent, or Firm* — Meunier Carlin & Curfman LLC

(57) ABSTRACT

A patient therapy device for providing treatment to a patient. The therapy device improves conformance to a joint and adjoining body parts. The device includes an angle adjustment assembly for forming the device into one of a plurality of predefined angles. The predefined angles may correspond to a desired angle of a joint during treatment. Further disclosed is a device for assisting a user with applying the therapy device to a body part. Also disclosed are methods of administering a treatment to an animate body.

29 Claims, 12 Drawing Sheets

(56) References Cited

U.S. PATENT DOCUMENTS 2,531,074 A 11/1950 Miller
2,540,547 A 2/1951 Rodert
2,549,703 A 4/1951 New
2,608,690 A 9/1952 Kolb et al.
2,703,770 A 3/1955 Melzer
2,726,658 A 12/1955 Chessey
2,750,940 A 6/1956 Fear
2,954,898 A 10/1960 Feeberg
3,261,042 A 7/1966 Baker
3,320,682 A 5/1967 Sliman
3,354,898 A 11/1967 Barnes
3,404,680 A 10/1968 Gutman et al.
3,559,640 A * 2/1971 Beckett ..... A61F 5/3746 2/94
3,561,435 A 2/1971 Nicholson
3,738,367 A 6/1973 Hardy
3,744,555 A 7/1973 Fletcher et al.
3,830,676 A 8/1974 Elkins
3,871,381 A 3/1975 Roslonski
3,901,225 A 8/1975 Sconce
3,993,053 A 11/1976 Grossan
4,020,209 A 4/1977 Yuan
4,026,299 A 5/1977 Sauder
4,116,476 A 9/1978 Porter et al.
4,118,946 A 10/1978 Tubin
4,147,921 A 4/1979 Walter et al.
4,149,529 A 4/1979 Copeland et al.
4,149,541 A 4/1979 Gammons et al.
4,170,998 A 10/1979 Sauder
4,184,537 A 1/1980 Sauder
4,194,247 A 3/1980 Melander
4,320,746 A 3/1982 Arkans et al.
4,335,726 A 6/1982 Kolstedt
4,338,944 A 7/1982 Arkans
4,355,635 A 10/1982 Bihl et al.
D269,379 S 6/1983 Bledsoe
4,407,276 A 10/1983 Bledsoe
4,412,648 A 11/1983 Ford et al.
4,436,125 A 3/1984 Blenkush
4,441,504 A 4/1984 Peterson et al.
4,460,085 A 7/1984 Jantzen
4,463,751 A 8/1984 Bledsoe
4,471,759 A 9/1984 Anderson et al.
4,478,436 A 10/1984 Hashimoto
4,547,906 A 10/1985 Nishida
4,550,828 A 11/1985 Baldwin et al.
4,597,384 A 7/1986 Whitney
4,598,702 A * 7/1986 Lilla ..... A61F 5/3738 602/4
4,617,923 A 10/1986 Coleman
4,625,719 A 12/1986 Chambers
4,678,027 A 7/1987 Shirey et al.
4,691,762 A 9/1987 Elkins et al.
4,699,613 A 10/1987 Donawick et al.
4,718,429 A 1/1988 Smidt
4,738,119 A 4/1988 Zafred
4,753,268 A 6/1988 Palau
4,765,338 A 8/1988 Turner et al.
4,817,588 A 4/1989 Bledsoe
4,834,073 A 5/1989 Bledsoe et al.
4,844,072 A 7/1989 French et al.
4,884,304 A 12/1989 Elkins
4,925,603 A 5/1990 Nambu
4,955,369 A 9/1990 Bledsoe et al.
4,955,435 A 9/1990 Shuster et al.
4,962,761 A 10/1990 Golden
4,964,282 A 10/1990 Wagner
4,964,402 A 10/1990 Grim et al.
4,966,145 A 10/1990 Kikumoto et al.
4,976,262 A 12/1990 Palmacci
5,002,270 A 3/1991 Shine
5,014,695 A 5/1991 Benak et al.
5,022,109 A 6/1991 Pekar
5,033,136 A 7/1991 Elkins
5,052,725 A 10/1991 Meyer et al.
5,056,563 A 10/1991 Glossop
5,072,875 A 12/1991 Zacoi
5,074,285 A * 12/1991 Wright ..... 601/15
5,076,068 A 12/1991 Mikhail
5,080,089 A 1/1992 Mason et al.
5,080,166 A 1/1992 Haugeneder
5,086,771 A 2/1992 Molloy
5,095,894 A 3/1992 Marble
5,097,829 A 3/1992 Quisenberry
5,104,158 A 4/1992 Meyer et al.
5,112,045 A 5/1992 Mason et al.
5,113,877 A 5/1992 Johnson, Jr. et al.
5,163,425 A 11/1992 Nambu et al.
5,163,923 A 11/1992 Donawick et al.
5,172,689 A 12/1992 Wright
5,186,698 A 2/1993 Mason et al.
5,201,552 A 4/1993 Hohmann et al.
5,230,335 A * 7/1993 Johnson et al. ..... 607/104
5,232,020 A 8/1993 Mason et al.
5,241,951 A 9/1993 Mason et al.
5,243,706 A 9/1993 Frim et al.
5,269,369 A 12/1993 Faghri
D345,609 S 3/1994 Mason et al.
5,294,156 A 3/1994 Kumazaki et al.
D345,802 S 4/1994 Mason et al.
D345,803 S 4/1994 Mason et al.
5,303,716 A 4/1994 Mason et al.
5,305,712 A 4/1994 Goldstein
5,314,455 A 5/1994 Johnson, Jr. et al.
5,316,250 A 5/1994 Mason et al.
5,316,547 A 5/1994 Gildersleeve
D348,106 S 6/1994 Mason et al.
5,324,319 A 6/1994 Mason et al.
D348,518 S 7/1994 Mason et al.
5,334,132 A 8/1994 Burkhead
D351,472 S 10/1994 Mason et al.
5,352,174 A 10/1994 Mason et al.
5,353,605 A 10/1994 Naaman
5,354,101 A 10/1994 Anderson, Jr.
5,354,103 A 10/1994 Torrence et al.
D352,781 S 11/1994 Mason et al.
5,372,575 A 12/1994 Sebastian
5,383,689 A 1/1995 Wolfe, Sr.
5,383,919 A 1/1995 Kelly et al.
RE34,883 E 3/1995 Grim
5,395,399 A 3/1995 Rosenwald
5,407,421 A 4/1995 Goldsmith
5,411,541 A 5/1995 Bell et al.
5,415,625 A 5/1995 Cassford et al.
5,417,720 A 5/1995 Mason
5,419,757 A 5/1995 Daneshvar
5,427,577 A 6/1995 Picchietti et al.
5,441,533 A 8/1995 Johnson et al.
5,449,379 A 9/1995 Hadtke
5,451,201 A 9/1995 Prengler
5,464,383 A 11/1995 Padden et al.
5,466,250 A 11/1995 Johnson, Jr. et al.
5,468,220 A 11/1995 Sucher
5,470,353 A 11/1995 Jensen
5,476,489 A 12/1995 Koewler
5,484,448 A 1/1996 Steele et al.
5,494,074 A 2/1996 Ramacier, Jr. et al.
5,496,358 A 3/1996 Rosenwald
5,507,792 A 4/1996 Mason et al.
5,514,081 A * 5/1996 Mann ..... 602/20
5,520,622 A 5/1996 Bastyr et al.
5,524,293 A 6/1996 Kung
5,527,268 A 6/1996 Gildersleeve et al.
5,533,354 A 7/1996 Pirkle
5,539,934 A 7/1996 Ponder
D372,534 S 8/1996 Andrews et al.
5,553,712 A 9/1996 Tisbo et al.
5,554,119 A 9/1996 Harrison et al.
5,556,138 A 9/1996 Nakajima et al.
5,558,626 A 9/1996 Holtzman et al.
5,564,124 A 10/1996 Elsherif et al.
5,569,172 A * 10/1996 Padden ..... A61F 5/3753 128/878
5,592,694 A 1/1997 Yewer

(56) References Cited

U.S. PATENT DOCUMENTS 5,609,620 A 3/1997 Daily
5,630,328 A 5/1997 Hise et al.
5,634,940 A 6/1997 Panyard
5,638,707 A 6/1997 Gould
5,645,671 A 7/1997 Tillinghast
D382,113 S 8/1997 DuRapau
D383,547 S 9/1997 Mason et al.
D383,848 S 9/1997 Mason et al.
5,662,239 A 9/1997 Heuvelman
5,662,695 A 9/1997 Mason et al.
5,672,152 A 9/1997 Mason et al.
5,683,118 A 11/1997 Slocum
5,716,388 A 2/1998 Petelle
5,728,058 A 3/1998 Ouellette et al.
5,732,464 A 3/1998 Lamont
5,755,755 A 5/1998 Panyard
5,769,801 A 6/1998 Tumey et al.
5,772,618 A 6/1998 Mason et al.
5,782,780 A 7/1998 Mason et al.
5,792,216 A 8/1998 Kappel
5,807,294 A 9/1998 Cawley et al.
5,827,208 A 10/1998 Mason et al.
5,830,165 A 11/1998 Rowe et al.
5,833,638 A 11/1998 Nelson
5,862,675 A 1/1999 Scaringe et al.
5,865,841 A 2/1999 Kolen et al.
5,866,219 A 2/1999 McClure et al.
5,868,690 A 2/1999 Eischen, Sr.
5,871,526 A 2/1999 Gibbs et al.
5,895,418 A 4/1999 Saringer
5,913,885 A 6/1999 Klatz et al.
5,920,934 A 7/1999 Hannagan et al.
5,951,598 A 9/1999 Bishay et al.
5,967,225 A 10/1999 Jenkins
5,968,072 A 10/1999 Hite et al.
5,970,519 A 10/1999 Weber
5,980,561 A 11/1999 Kolen et al.
5,984,885 A 11/1999 Gaylord, Jr. et al.
5,989,285 A 11/1999 DeVilbiss et al.
5,992,459 A 11/1999 Sugita et al.
5,997,495 A 12/1999 Cook et al.
6,030,412 A 2/2000 Klatz et al.
6,036,107 A 3/2000 Aspen et al.
6,036,718 A 3/2000 Ledford et al.
6,048,326 A 4/2000 Davis et al.
6,053,169 A 4/2000 Hunt
6,055,670 A 5/2000 Parker
6,058,508 A * 5/2000 Brown Honeysuckle ..... A41D 15/002 2/69
6,074,413 A 6/2000 Davis et al.
6,083,256 A 7/2000 Der Ovanesian
D430,288 S 8/2000 Mason et al.
D430,289 S 8/2000 Mason et al.
6,095,993 A 8/2000 Hawkins
6,105,382 A 8/2000 Reason
6,109,338 A 8/2000 Butzer
6,117,164 A 9/2000 Gildersleeve et al.
6,146,347 A 11/2000 Porrata
6,146,413 A 11/2000 Harman
6,156,059 A 12/2000 Olofsson
6,178,562 B1 1/2001 Elkins
6,228,106 B1 5/2001 Simbruner et al.
6,238,427 B1 5/2001 Matta
6,254,554 B1 7/2001 Turtzo
6,260,890 B1 7/2001 Mason
6,261,314 B1 7/2001 Rich
6,270,481 B1 8/2001 Mason et al.
6,306,112 B2 10/2001 Bird
6,328,276 B1 12/2001 Falch et al.
6,349,412 B1 2/2002 Dean
6,352,550 B1 3/2002 Gildersleeve et al.
6,354,635 B1 3/2002 Dyson et al.
6,361,514 B1 3/2002 Brown et al.
6,368,357 B1 4/2002 Schon et al.
6,371,976 B1 4/2002 Vrzalik et al.
6,382,678 B1 5/2002 Field et al.
6,398,748 B1 6/2002 Wilson
6,405,080 B1 6/2002 Lasersohn et al.
6,406,445 B1 * 6/2002 Ben-Nun ..... A61H 9/0078 601/149
6,440,159 B1 8/2002 Edwards et al.
6,443,498 B1 9/2002 Liao
6,508,831 B1 1/2003 Kushnir
6,547,284 B2 4/2003 Rose et al.
6,551,264 B1 4/2003 Cawley et al.
6,551,347 B1 4/2003 Elkins
6,551,348 B1 4/2003 Blalock et al.
6,620,187 B2 9/2003 Carson et al.
6,641,601 B1 11/2003 Augustine et al.
6,645,232 B2 11/2003 Carson
6,660,027 B2 12/2003 Gruszecki et al.
D486,870 S 2/2004 Mason
6,695,872 B2 2/2004 Elkins
6,699,267 B2 3/2004 Voorhees et al.
6,719,713 B2 4/2004 Mason
6,719,728 B2 4/2004 Mason et al.
6,802,823 B2 10/2004 Mason
6,818,012 B2 11/2004 Ellingboe
6,823,682 B1 11/2004 Jenkins et al.
6,871,878 B2 3/2005 Miros
6,893,414 B2 5/2005 Goble et al.
6,926,311 B2 8/2005 Chang et al.
6,932,304 B1 8/2005 Villamar
6,936,019 B2 8/2005 Mason
6,942,015 B1 9/2005 Jenkins
6,945,945 B2 9/2005 Givler et al.
6,948,501 B2 9/2005 Rastegar et al.
7,008,445 B2 3/2006 Lennox
7,017,213 B2 3/2006 Chisari
7,018,349 B1 3/2006 Joslin
7,025,709 B2 4/2006 Riggall
7,059,329 B2 6/2006 Mason et al.
7,060,045 B2 6/2006 Mason et al.
7,060,086 B2 6/2006 Wilson et al.
7,093,903 B2 8/2006 O'Connor et al.
7,107,629 B2 9/2006 Miros et al.
7,108,664 B2 9/2006 Mason et al.
7,117,569 B2 10/2006 Bledsoe
7,125,417 B2 10/2006 Mizrahi
7,141,131 B2 11/2006 Foxen et al.
7,156,054 B1 1/2007 York
7,166,083 B2 1/2007 Bledsoe
7,191,798 B2 3/2007 Edelman et al.
7,198,093 B1 4/2007 Elkins
7,235,059 B2 6/2007 Mason et al.
7,244,239 B2 7/2007 Howard
7,306,568 B2 12/2007 Diana
7,308,304 B2 12/2007 Hampton et al.
7,326,196 B2 2/2008 Olsen et al.
7,418,755 B2 9/2008 Bledsoe et al.
7,434,844 B2 10/2008 Kao
7,448,653 B2 11/2008 Jensen et al.
7,479,122 B2 1/2009 Ceriani et al.
7,485,103 B2 2/2009 Mason et al.
7,490,620 B2 2/2009 Tesluk et al.
7,500,957 B2 3/2009 Bledsoe
7,640,764 B2 1/2010 Gammons et al.
7,658,205 B1 2/2010 Edelman et al.
7,694,693 B1 4/2010 Edelman et al.
7,731,244 B2 6/2010 Miros et al.
7,744,551 B2 * 6/2010 Pick ..... A61F 5/0102 602/14
7,785,283 B1 8/2010 Bledsoe
7,833,184 B2 11/2010 Chiodo et al.
7,837,638 B2 * 11/2010 Miros et al. ..... 602/13
7,864,941 B1 1/2011 Bledsoe et al.
7,871,427 B2 1/2011 Dunbar et al.
7,896,910 B2 3/2011 Schirrmacher et al.
7,908,692 B2 3/2011 Lange
7,914,563 B2 3/2011 Mason et al.
7,959,588 B1 6/2011 Wolpa
7,988,653 B2 8/2011 Fout et al.
8,016,779 B2 9/2011 Brown et al.

(56) References Cited

U.S. PATENT DOCUMENTS 8,052,628 B1 11/2011 Edelman et al.
8,066,752 B2 11/2011 Hamilton et al.
8,109,273 B2 * 2/2012 Golden ..... A61F 5/05841 128/846
8,182,521 B2 5/2012 Kane et al.
8,216,163 B2 7/2012 Edelman
8,216,290 B2 7/2012 Shawver et al.
8,216,398 B2 7/2012 Bledsoe et al.
8,226,698 B2 7/2012 Edelman et al.
8,251,932 B2 8/2012 Fout
8,251,936 B2 8/2012 Fout et al.
8,273,045 B2 9/2012 Ceriani
8,277,403 B2 10/2012 Ceriani et al.
8,328,742 B2 12/2012 Bledsoe
8,414,512 B2 4/2013 Fout
8,419,670 B2 4/2013 Downing
8,425,579 B1 4/2013 Edelman et al.
8,444,581 B1 5/2013 Maxon-Maldonado et al.
8,512,263 B2 8/2013 Gammons
8,613,762 B2 12/2013 Bledsoe
2001/0018604 A1 8/2001 Elkins
2001/0034545 A1 10/2001 Elkins
2001/0034546 A1 10/2001 Elkins
2001/0039439 A1 11/2001 Elkins et al.
2002/0019657 A1 2/2002 Elkins
2002/0026226 A1 2/2002 Ein
2002/0032473 A1 3/2002 Kushnir et al.
2002/0041621 A1 4/2002 Faries et al.
2002/0058975 A1 5/2002 Bieberich
2002/0082668 A1 6/2002 Ingman
2002/0093189 A1 7/2002 Krupa
2002/0108279 A1 8/2002 Hubbard et al.
2003/0060761 A1 3/2003 Evans et al.
2003/0196352 A1 10/2003 Bledsoe et al.
2004/0064170 A1 4/2004 Radons et al.
2004/0064171 A1 4/2004 Briscoe et al.
2004/0068309 A1 4/2004 Edelman
2004/0158303 A1 8/2004 Lennox et al.
2004/0167594 A1 8/2004 Elkins
2004/0210283 A1 10/2004 Rose et al.
2004/0225341 A1 11/2004 Schock et al.
2004/0243202 A1 12/2004 Lennox
2005/0027173 A1 2/2005 Briscoe et al.
2005/0065581 A1 3/2005 Fletcher et al.
2005/0126578 A1 6/2005 Garrison et al.
2005/0131324 A1 6/2005 Bledsoe
2005/0136213 A1 6/2005 Seth et al.
2005/0143796 A1 6/2005 Augustine et al.
2005/0143797 A1 6/2005 Parish et al.
2005/0256556 A1 * 11/2005 Schirrmacher ..... A61F 7/02 607/104
2006/0058858 A1 3/2006 Smith
2006/0144557 A1 7/2006 Koscheyev et al.
2006/0190062 A1 8/2006 Worthen
2006/0200057 A1 9/2006 Sterling
2006/0287697 A1 12/2006 Lennox
2007/0043311 A1 2/2007 Jaggan-Vince
2007/0060987 A1 3/2007 Grahn et al.
2007/0068651 A1 3/2007 Gammons et al.
2007/0108829 A1 5/2007 Lehn et al.
2007/0118194 A1 5/2007 Mason et al.
2007/0118965 A1 5/2007 Hoffman
2007/0157931 A1 7/2007 Parker et al.
2007/0161932 A1 7/2007 Pick et al.
2007/0161933 A1 7/2007 Ravikumar
2007/0167895 A1 * 7/2007 Gramza et al. ..... 602/26
2007/0191918 A1 8/2007 MacHold et al.
2007/0282230 A1 12/2007 Valderrabano et al.
2008/0000474 A1 1/2008 Jochle et al.
2008/0058911 A1 3/2008 Parish et al.
2008/0065172 A1 3/2008 Magdych
2008/0067095 A1 3/2008 Mueller
2008/0097560 A1 4/2008 Radziunas et al.
2008/0097561 A1 4/2008 Melsky et al.
2008/0132816 A1 6/2008 Kane et al.
2008/0132976 A1 6/2008 Kane et al.
2008/0161891 A1 7/2008 Pierre et al.
2008/0234788 A1 9/2008 Wasowski
2008/0249593 A1 10/2008 Cazzini et al.
2008/0269852 A1 10/2008 Lennox et al.
2008/0275534 A1 11/2008 Noel
2008/0283426 A1 11/2008 Primer et al.
2009/0005841 A1 1/2009 Schirrmacher et al.
2009/0018623 A1 1/2009 Levinson et al.
2009/0038195 A1 2/2009 Riker et al.
2009/0062890 A1 3/2009 Ugajin et al.
2009/0069731 A1 * 3/2009 Parish ..... A61F 7/0085 601/150
2009/0088673 A1 4/2009 Bittar
2009/0183410 A1 7/2009 Tursso et al.
2009/0192424 A1 7/2009 Choudhury et al.
2010/0006631 A1 1/2010 Edwards et al.
2010/0076531 A1 3/2010 Beran et al.
2010/0089896 A1 4/2010 Bart
2010/0094187 A1 * 4/2010 Murinson ..... A61F 5/0118 602/20
2010/0121237 A1 5/2010 Ylisela et al.
2010/0137951 A1 6/2010 Lennox et al.
2010/0137953 A1 6/2010 Stein
2010/0139294 A1 6/2010 Lowe et al.
2010/0145421 A1 6/2010 Tomlinson et al.
2010/0161013 A1 6/2010 Heaton
2010/0217349 A1 8/2010 Fahey
2010/0241120 A1 9/2010 Bledsoe et al.
2011/0004132 A1 1/2011 Cook
2011/0028873 A1 2/2011 Miros et al.
2011/0040359 A1 2/2011 Harris et al.
2011/0046700 A1 2/2011 McDonald et al.
2011/0087142 A1 4/2011 Ravikumar et al.
2011/0098792 A1 4/2011 Lowe et al.
2011/0098793 A1 4/2011 Lowe et al.
2011/0106023 A1 5/2011 Lowe
2011/0152982 A1 6/2011 Richardson
2011/0152983 A1 6/2011 Schirrmacher et al.
2011/0172749 A1 7/2011 Christensen et al.
2011/0307038 A1 12/2011 Stiehr
2012/0010546 A1 * 1/2012 Sotereanos ..... A61F 5/0118 602/4
2012/0028764 A1 2/2012 Miller
2012/0143111 A1 6/2012 Bledsoe et al.
2012/0172774 A1 7/2012 Lowe et al.
2012/0172955 A1 7/2012 Dewaegenaere
2012/0179084 A1 7/2012 Lipshaw et al.
2012/0233736 A1 9/2012 Tepper et al.
2012/0245483 A1 9/2012 Lundqvist
2012/0288848 A1 11/2012 Latham et al.
2012/0330199 A1 12/2012 Lurie et al.
2012/0330202 A1 12/2012 Flick
2013/0090683 A1 4/2013 Schock
2013/0123890 A1 5/2013 Latham
2013/0165847 A1 6/2013 Scarpaci et al.
2013/0190553 A1 7/2013 Wong et al.
2013/0245519 A1 9/2013 Edelman et al.
2013/0245729 A1 9/2013 Edelman et al.
2013/0296981 A1 11/2013 Saggers
2014/0222121 A1 8/2014 Spence et al.
2014/0236256 A1 8/2014 Rossing
2014/0243939 A1 8/2014 Lowe et al.
2014/0316314 A1 10/2014 Schubert
2015/0374538 A1 12/2015 Rogers
2016/0030234 A1 2/2016 Lofy et al.
2016/0128865 A1 5/2016 Lowe
2016/0166428 A1 6/2016 Hilton et al.
2017/0216129 A1 8/2017 Lowe et al.
2018/0271688 A1 9/2018 Miros et al.

FOREIGN PATENT DOCUMENTS

CN 2880025 Y 3/2007
CN 201001805 Y 1/2008
CN 201070419 Y 6/2008
CN 101524301 A 9/2009
DE 3343664 3/1985
DE 29716336 U1 1/1998

(56) References Cited

FOREIGN PATENT DOCUMENTS

| | | | |
|---|---|---|---|
| DE | 29716338 | U1 | 1/1998 |
| EP | 0344949 | A2 | 12/1989 |
| EP | 0412708 | A1 | 2/1991 |
| EP | 0535830 | A1 | 4/1993 |
| EP | 0861651 | B1 | 4/2002 |
| EP | 1329676 | A1 | 7/2003 |
| EP | 1393751 | A1 | 3/2004 |
| EP | 1972312 | A2 | 9/2008 |
| FR | 819022 | | 10/1937 |
| GB | 2417207 | | 2/2006 |
| JP | 08-229061 | A | 9/1996 |
| JP | 2000288007 | A | 10/2000 |
| KR | 100654317 | B1 | 12/2006 |
| WO | WO 86/03399 | A1 | 6/1986 |
| WO | WO92/13506 | A1 | 8/1992 |
| WO | WO92/15263 | A1 | 9/1992 |
| WO | WO94/09732 | A1 | 5/1994 |
| WO | WO96/26693 | A1 | 9/1996 |
| WO | WO98/07397 | A1 | 2/1998 |
| WO | WO99/44552 | A1 | 9/1999 |
| WO | WO00/23016 | A1 | 4/2000 |
| WO | WO00/55542 | A1 | 9/2000 |
| WO | WO00/67685 | A1 | 11/2000 |
| WO | WO0154635 | A1 | 8/2001 |
| WO | WO02/19954 | A2 | 3/2002 |
| WO | WO02/38091 | A1 | 5/2002 |
| WO | WO 03/000079 | A2 | 1/2003 |
| WO | WO03/072008 | A2 | 9/2003 |
| WO | WO2005/007060 | A2 | 1/2005 |
| WO | WO2005/082301 | A1 | 9/2005 |
| WO | WO2006/110405 | A2 | 10/2006 |
| WO | WO2010/060931 | A1 | 6/2010 |
| WO | WO2011/019603 | A1 | 2/2011 |

OTHER PUBLICATIONS

Elkins, U.S. Appl. No. 09/173,637 entitled "Compliant heat exchange splint and control unit," filed Oct. 16, 1998.

Lowe, U.S. Appl. No. 13/441,761 entitled "System for Providing Treatment to a Mammal and Method," filed Apr. 6, 2012.

Lowe, U.S. Appl. No. 13/441,767 entitled "Control Unit for a Therapy System and Method ," filed Apr. 6, 2012.

Lowe, U.S. Appl. No. 13/441,770 entitled "Thermal Therapy System," filed Apr. 6, 2012.

BioCompression Systems, Inc. (Moonachie, NJ); Product literature for Sequential Circulators; 15 pgs.; Oct. 1997.

Van Eps et al.; distal limb cryotherapy for the prevention of acute laminitis; Clin Tech Equine Pract; vol. 3; pp. 64-70; Mar. 2004.

Van Eps et al.; Equine laminitis: cryotherapy reduces the severity of the acute lesion; Equine Veterinary Journal; vol. 36; No. 3; pp. 255-260; Apr. 2004.

Lowe et al.; U.S. Appl. No. 14/095,954 entitled "Reinforced Therapeutic Wrap and Method," filed Dec. 3, 2013.

Cothera LLC; VPULSE System Users Manual; 100149 Rev E; © 2013; 18 pgs. (manual rev. dated Jul. 2013).

Schirrmacher et al.; U.S. Appl. No. 14/819,276 entitled "Integrated multisectional heat exchanger," filed Aug. 5, 2015.

Lowe et al.; U.S. Appl. No. 15/927,937 entitled Temperature and flow control methods in a thermal therapy device, filed Mar. 21, 2018.

Webster Dictionary; Shunt (definition); Merriam-Webster, Inc.; 11 pages; retrieved from the internet (https://www.merriam-webster.com/dictionary/shunt on Apr. 13, 2018.

Hilton et al., U.S. Appl. No. 16/178,467 entitled "Integrated multisectional heat exchanger," filed Nov. 1, 2018.

* cited by examiner

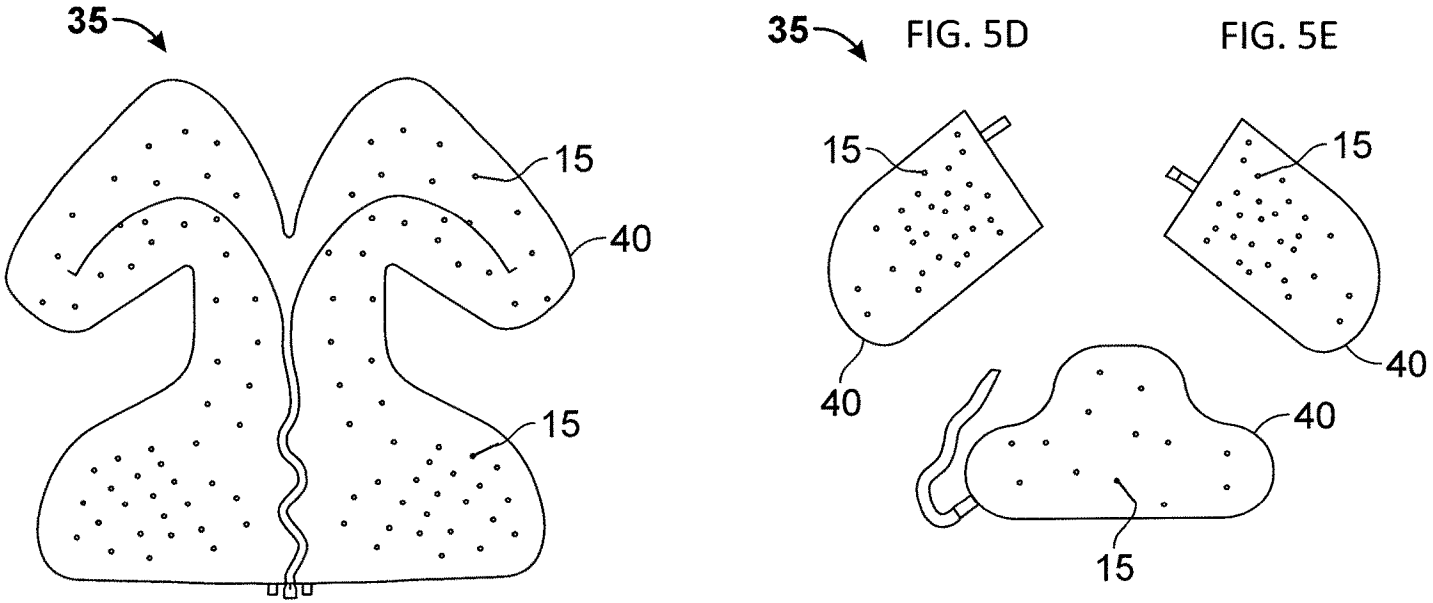
FIG. 5A
FIG. 5B
FIG. 5C
FIG. 5D
FIG. 5E
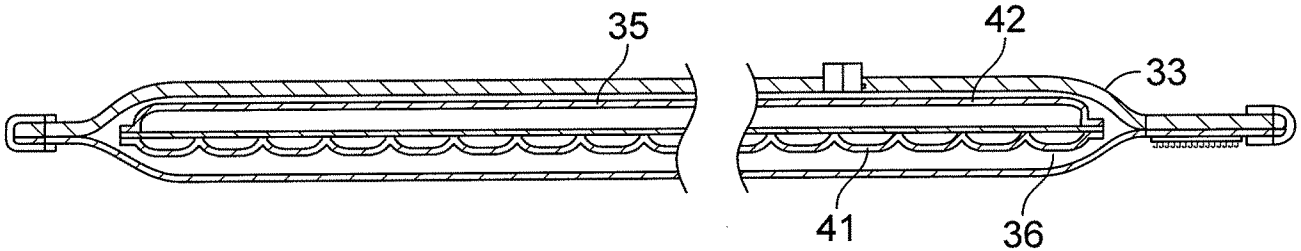

ADJUSTABLE PATIENT THERAPY DEVICE

CROSS REFERENCE TO RELATED APPLICATIONS

This application claims priority to U.S. Provisional Application No. 61/498,419, filed on Jun. 17, 2011, which is herein incorporated by reference in its entirety.

FIELD OF THE INVENTION

The present invention relates generally to a device for applying therapy to an animate body, and in various respects tissue of a jointed body part.

INCORPORATION BY REFERENCE

All publications and patent applications mentioned in this specification are herein incorporated by reference for all purposes to the same extent as if each individual publication or patent application was specifically and individually indicated to be incorporated by reference.

BACKGROUND OF THE INVENTION

It is known to provide temperature-controlled, compressive, and/or other therapy to the body. For example, temperature-controlled therapy has long been practiced for physical therapy, sports injuries, and other settings. Thermal therapy commonly includes cooling, heating, and/or applying compression to a traumatized area of a human body to facilitate healing and prevent unwanted consequences of the trauma. This form of therapy is commonly referred to as RICE (Rest, Ice, Compression and Elevation). RICE is also commonly used in sports medicine to reduce the risk of long-term damage to muscles and joints and/or alleviate pain and soreness.

There has been a focus with existing therapy wrap designs on improving conformance to body parts. Better conformance generally leads to improved therapy and the ability to use therapy wraps in a greater array of applications. Conventional therapy devices suffer from poor conformance to body parts that move, such as a joint.

There is a need for thermal therapy wraps with better conformance properties. There is the need for thermal therapy wraps applicable to more treatment settings and patient populations. There is a continuing need for therapy wraps with improved heat exchange performance. There is the need for therapy wraps that can be applied to a wide variety of anatomical shapes. There is a need for a therapy wrap that achieves better apposition of a therapy component to the body. There is a need for a temperature-controlled therapy system with improved patient comfort and/or reduced risks of injury to the body part treated. There is a need for improved systems and methods for heating, cooling, and/or compressing a body in need of treatment.

These and other problems are overcome by the invention disclosed herein.

SUMMARY OF THE INVENTION

The present invention involves improvements in therapy apparatus and avoids disadvantages in the prior art.

Various aspects of the invention are directed to a device for providing treatment to a body part, the device comprising a therapy component for applying thermal therapy, compression therapy, or both; a sleeve for receiving the therapy device and sized to cover an anatomical joint and an adjacent body part when the sleeve is positioned on a body; and an adjustment assembly for adjusting an angle of the sleeve to conform to the joint. In various embodiments, the anatomical joint can be bent.

In various embodiments, the adjustment assembly is formed on the sleeve. The adjustment assembly may be configured to allow adjustment of the sleeve to one of a plurality of discrete, predetermined settings.

In various embodiments, the therapy component comprises a fluid bladder. The bladder may be configured to circulate a heat transfer fluid to transfer heat between the therapy component and the body part. The bladder may be a gas pressure bladder for applying a compressive force to the body part. In various embodiments, the therapy component comprises a fluid bladder and a gas pressure bladder. In various embodiments, the therapy component comprises a fluid bladder for circulating a heated or cooled fluid and a gas pressure bladder for applying a compressive force, the fluid bladder having a treatment side and the gas pressure bladder being positioned on an opposite side of the fluid bladder as the treatment side.

In various embodiments, the sleeve is sized to cover the joint, an upper portion of the body above the joint, and a lower portion of the body below the joint. In various embodiments, the therapy component is positioned to cover the upper portion, the lower portion, or both when the device is positioned on the body. In various embodiments, the therapy component does not extend over the joint when the device is positioned on the body.

Various aspects of the invention are directed to a medical device for a mammalian body part, comprising a sleeve sized to extend over an anatomical joint, an upper portion of the body above the joint, and a lower portion of the body below the joint; and an adjustment assembly configured to provide adjustment of an angle of the sleeve. In various embodiments, the anatomical joint can be bent. In various embodiments, the adjustment assembly is positioned entirely on one of the lower portion or the upper portion.

In various embodiments, the joint is an elbow and the sleeve is sized to extend over at least portions of an upper arm and a forearm. The adjustment assembly may be positioned entirely on a portion of the sleeve corresponding to the upper arm. The sleeve may be configured to attach to the lower portion and upper portion. In various embodiments, the sleeve includes a cut-out for at least a portion of the joint. The joint may be a hinge joint such as an elbow or a knee. In various embodiments, the joint is one of a hinge joint, a saddle joint, an ellipsoidal joint, a ball-and-socket joint, a pivot joint, and a gliding joint.

In various embodiments, the device further includes a therapy component for positioning against the upper portion, the lower portion, or both using the sleeve. In various embodiments, the therapy component is a thermal therapy wrap.

Various aspects of the invention are directed to a device for providing treatment to a body part requiring treatment, the device comprising a sleeve sized to conform to a body part including an anatomical joint, the sleeve including a pouch adapted to receive a therapy component, an upper portion corresponding to one side of the joint, and a lower portion corresponding to an opposite side of the joint when the sleeve is positioned on the body part; and an angle adjustment assembly for adjusting an angle of the sleeve and formed on the upper portion or lower portion of the sleeve. In various embodiments, the anatomical joint can be bent. In various embodiments, the angle adjustment assembly includes a first adjustment portion configured to fasten to a plurality of second adjustment portions. In various embodiments, the plurality of second portions are spaced from one another at discrete locations.

In various embodiments, the device further includes a therapy component secured within the sleeve pouch, the therapy component including a heat transfer device adapted to transfer heat between the device and the body part. The heat transfer device may include an inflatable bladder for applying a compressive force to the body part.

Various aspects of the invention are directed to a device including any of the features described in the forgoing paragraphs.

Various aspects of the invention are directed to a method for providing treatment to a patient, comprising preparing a medical device for administering treatment to a body part including a joint of a patient, the device comprising a therapy component and a sleeve for applying the therapy component to the body part, wherein the sleeve is formed into one of a plurality of predefined angles; applying the medical device to the body part; and administering a first treatment to the body part using the medical device.

In various embodiments, the method further includes removing the medical device from the body part; changing an angle of the sleeve from the one angle to another angle among the plurality of predefined angles; and re-applying the medical device to the body part. In various embodiments, the one predefined angle is based on the first treatment conditions.

In various embodiments, the method further includes administering a second treatment to the body part after changing the angle of the sleeve. In various embodiments, the another predefined angle is based on the second treatment conditions.

In various embodiments, the administering treatment comprises treatment for recovery after ulnar collateral ligament (UCL) reconstruction surgery.

In various embodiments, the administering treatment comprises temperature-controlled therapy, compression therapy, or both.

In various embodiments, the sleeve comprises an angle adjustment assembly including a first adjustment portion configured to fasten to a plurality of second adjustment portions, the plurality of second portions being spaced from one another at discrete locations; and wherein medical device is prepared by fastening the first adjustment portion to one of the plurality of second adjustment portions. In various embodiments, the changing of the angle is accomplished by fastening the first adjustment portion to a different one of the plurality of second adjustment portions.

Various aspects of the invention are directed to a system for administering therapy to a patient, comprising a therapy wrap sized to conform to an anatomical body part, the wrap comprising a body and first fastener tab extending from the body, the first fastener tab configured to wrap over the body part and fasten to a fastener receiver portion of the wrap to secure the wrap on the body part; and an auxiliary fastening mechanism for assisting a user with wrapping the first fastener tab over the body part. In various embodiments, the auxiliary fastening mechanism includes a body with a fastener at one end. In various embodiments, the auxiliary fastening mechanism includes a body with a fastener at each end. In various embodiments, the auxiliary fastening mechanism includes a body with a fastener at one end for securing to the first fastening tab and another fastener at an opposite end for securing to the fastener receiver portion.

In various embodiments, the wrap includes a second fastener tab. The first fastener tab may be configured to wrap over the body part in one direction, and the second fastener tab may be configured to wrap over the body party in an opposite direction. In various embodiments, the first and second fastener tabs overlap when wrapped over the body part.

In various embodiments, the therapy wrap further comprises a therapy component for applying at least one of thermal therapy and compression therapy. In various embodiments, the therapy wrap further comprises an angle adjustment assembly for adjusting an angle of the wrap.

In various embodiments, the auxiliary fastening mechanism body is elongate.

In various embodiments, the fastening mechanism body is formed of a material that stretches. In various embodiments, the fasteners each include a relatively rigid backing material.

In various embodiments, one end of the auxiliary fastening mechanism is permanently affixed to the wrap.

In various embodiments, the wrap comprises a removable sleeve.

The device and method of the present invention have other features and advantages which will be apparent from or are set forth in more detail in the accompanying drawings, which are incorporated in and form a part of this specification, and the following Detailed Description of the Invention, which together serve to explain the principles of the present invention.

BRIEF DESCRIPTION OF THE DRAWINGS

FIG. 5A is a top view of a therapy component for forming part of the therapy component of FIG. 4. FIG. 5B is a top view of another therapy component for forming part of the therapy component of FIG. 4. FIG. 5C is a cross-sectional view of a portion of the therapy device of FIG. 4 taken through the line 5C-5C, illustrating a multi-bladder assembly positioned within the sleeve. FIGS. 5D and 5E illustrate embodiments of other components of the multi-bladder assembly.

FIGS. 6A, 6B and 6C are various enlarged portions of FIG. 6.

DETAILED DESCRIPTION OF THE INVENTION

Figure 1:
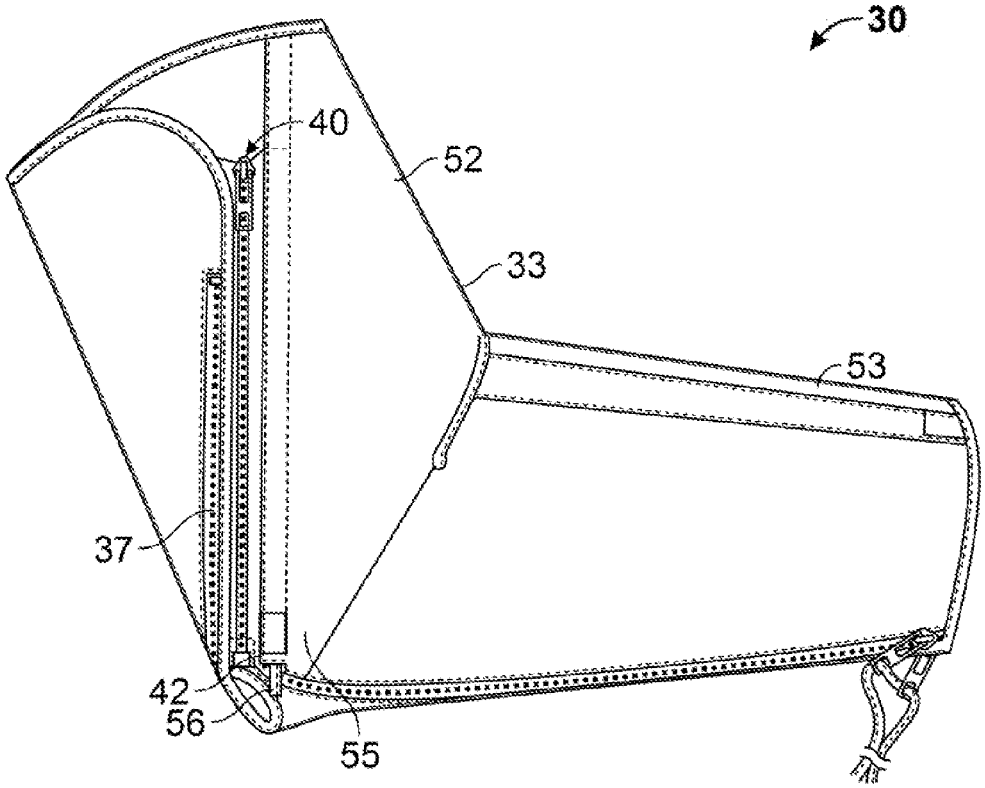
FIG. 1 is a front view of a patient therapy device in one of a plurality of predefined angles in accordance with aspects of the invention, the exemplary therapy device including a sleeve and a therapy component.

Before the present invention is described, it is to be understood that this invention is not intended to be limited to particular embodiments or examples described. Further, when referring to the drawings, like numerals indicate like elements.

Unless expressly stated otherwise, the terms used herein are to be understood as used by one of ordinary skill in the art. In various respects, use of the singular in connection with the terms herein includes the plural and vice versa.

"Body" is to be understood as used in the medical and biological fields and generally includes any animate body including, but not limited to, mammals. In various respects, "body" refers to human or equine patients. In various respects "body part" and "body" are used interchangeably to refer to an animate subject in need of treatment.

As used herein, "body part" is used in the broadest sense and generally refers to a part or portion of a body to receive treatment. In various respects, "body part" refers to a part of a body having a joint or bend. In various respects, "body part" and "joint" are used somewhat interchangeably.

For convenience in explanation and accurate definition in the appended claims, the terms "up" or "upper", "down" or "lower", "inside" and "outside" are used to describe features of the present invention with reference to the positions of such features as displayed in the figures.

In many respects the modifications of the various figures resemble those of preceding modifications and the same reference numerals followed by "a", "b", "c", and "d" designate corresponding parts.

FIG. 1 illustrates an exemplary patient therapy device, generally designated 30. The therapy device is configured for administering treatment to a body. In various embodiments the therapy device is a thermal therapy apparatus including a heat transfer device. One will appreciate from the description herein, however, that the device may be applicable for administering many other therapeutic treatments.

With references generally to FIGS. 1-4, the exemplary therapy device includes a sleeve for applying to a body part requiring treatment. In various embodiments, the body part includes a joint and portion of the body adjacent the joint. In the example of a human patient, the device may be configured for applying to an elbow and an arm, a knee and a leg, a shoulder and an arm, a wrist and an arm, or a wrist and a hand. The sleeve may be configured to cover all or a portion of the joint and/or body part.

Exemplary therapy device 30 is a therapy wrap including a therapy component and a sleeve for positioning the therapy component on a body part to be treated. The exemplary therapy device is in the form of a wrap for connecting various components to the patient's body.

The exemplary device is configured for administering temperature-controlled therapy to a body including, but not limited to, the application of cooling, heating, and/or compression. Specifically, the exemplary therapy component is a thermal therapy device including a heat exchanger to exchange heat with the body part and a compressive mechanism for applying a compressive force to the body part.

The exemplary heat exchanger is a compliant fluid bladder for circulating a heat transfer medium. The exemplary compressive mechanism is a compliant gas pressure bladder that overlays the fluid bladder. The gas pressure bladder directs a compressive force to the fluid bladder to press the bladder against the body part to be subjected to heat exchange and apply compression to the body part. Compression therapy is commonly used to reduce edema. It is commonly used in conjunction with heating or cooling therapy.

Various aspects of the therapy device may be similar to the devices disclosed by U.S. Pat. No. 7,107,629 to Miros et al. and U.S. Patent Pub. No. 2005/0256556 A1 to Schirrmacher et al., the entire contents of which are incorporated herein for all purposes by reference. The fluid bladder is adapted exchange heat with an adjacent body when the fluid is circulated in the bladder. The body may include, but is not limited to, a mammalian body such as a human or an equine animal. Various aspects of the use of the exemplary therapy device are similar to the techniques described in U.S. Pat. No. 6,178,562, the disclosure of which is herein incorporated for all purposes by reference.

Various aspects of the invention are similar to the subject matter described in: U.S. patent application Ser. No. 09/127,256 (filed Jul. 31, 1998) entitled, "Compliant Heat Exchange Panel" issued on Apr. 3, 2007 as U.S. Pat. No. 7,198,093; U.S. patent application Ser. No. 09/798,261 (filed Mar. 1, 2001) entitled, "Shoulder Conformal Therapy Component of an Animate Body Heat Exchanger" published on Aug. 30, 2001 as U.S. Publication No. 2001-0018604A1; U.S. patent application Ser. No. 09/901,963 (filed Jul. 10, 2001) entitled, "Compliant Heat Exchange Splint and Control Unit" published on Nov. 8, 2001 as U.S. Publication No. 2001-0039439A1; U.S. patent application Ser. No. 09/771,123 (filed Jan. 26, 2001) entitled, "Wrist/Hand Conformal Therapy Component of an Animate Body Heat Exchanger" published on Oct. 25, 2001 as U.S. Publication No. 2001-0034546A1; U.S. patent application Ser. No. 09/771,124 (filed Jan. 26, 2001) entitled, "Foot/Ankle Conformal Therapy Component of an Animate Body Heat Exchanger" published on Feb. 14, 2002 as U.S. Publication No. 2002-0019657A1; U.S. patent application Ser. No. 09/771,125 (filed Jan. 26, 2001) entitled, "Conformal Therapy Component of an Animate Body Heat Exchanger having Adjustable Length Tongue" published on Oct. 25, 2001 as U.S. Publication No. 2001-0034545A1; U.S. patent application Ser. No. 10/784,489 (filed Feb. 23, 2004) entitled, "Therapy Component of an Animate Body Heat Exchanger" published on Aug. 26, 2004 as U.S. Publication No. 2004-0167594A1 which is a continuation of U.S. patent application Ser. No. 09/765,082 (filed Jan. 16, 2001) entitled, "Therapy Component of an Animate Body Heat Exchanger and Method of Manufacturing such a Component" issued on Feb. 24, 2004 as U.S. Pat. No. 6,695,872 which is a continuation-in-part of U.S. patent application Ser. No. 09/493,746 (filed Jan. 28, 2000) entitled, "Cap And Vest Garment Components Of An Animate Body Heat Exchanger" issued on Jan. 30, 2001 as U.S. Pat. No. 6,178,562; U.S. patent application Ser. No. 10/122,469 (filed Apr. 12, 2002) entitled, "Make-Break Connector For Heat Exchanger" issued on Mar. 29, 2005 as Pat. No. 6,871,878; U.S. patent application Ser. No. 10/637,719 (filed Aug. 8, 2003) entitled, "Apparel Including a Heat Exchanger" issued on Sep. 19, 2006 as U.S. Pat. No. 7,107,629; U.S. patent application Ser. No. 12/208,240 (filed Sep. 10, 2008) entitled, "Modular Apparatus for Therapy of an Animate Body" published on Jan. 1, 2009 as U.S. Publication No. 2009-0005841A1 which is a divisional of U.S. patent application Ser. No. 10/848,097 (filed May 17, 2004) entitled, "Modular Apparatus for Therapy of an Animate Body" issued on Mar. 1, 2011 as U.S. Pat. No. 7,896,910; U.S. patent application Ser. No. 11/707,419 (filed Feb. 13, 2007) entitled, "Flexible Joint Wrap" issued on Nov. 23, 2010 as U.S. Pat. No. 7,837,638; U.S. patent application Ser. No. 11/854,352 (filed Sep. 12, 2007) entitled, "Make-Break Connector Assembly with Opposing Latches" issued on Jun. 8, 2010 as U.S. Pat. No. 7,731,244, which is incorporated herein for all purposes by reference.

The above systems generally provide active heating, cooling, and/or compression for humans and other animal bodies. They are used, for example, in physical therapy, pre-game conditioning, minor injury care, post-operative care, and emergency medical care, among other applications.

Thermal therapy systems exist in a number of different forms. In general, there is a control unit, a connector hose, a therapy wrap comprising a heat transfer device and a sleeve cover, and a power source (i.e., battery or externally-powered electric source). One will appreciate, however, that the system components and configuration may be modified depending on the application. The system may include a control unit for controlling administration of therapy using the therapy device. The system may also include other components such as fluidics, a power source, a cooling and/or heating source, a communications system, input/output devices, and a pump.

The therapy device, and in particular the sleeve, may take different forms including, but not limited to, a vest, a wrist wrap, a head cap, a wrap for a body limb, a foot wrap, and more. In various respects, "therapy device" and "therapy wrap" are used interchangeably. The device may have a variety of shapes and sizes for applying to different anatomies and/or different parts of the body as would be appreciated by one of skill from the description herein. The parts of the body to receive treatment with the wrap include, but are not limited to, all or part of a torso, a thoracic region, a cranial region, a throat region, a limb (e.g. a thigh or arm), a heart region, a lung region, a chest region, a wrist, a foot, and a combination of the same. The device may be configured for positioning adjacent selected portions of the patient's vascular system, nervous system, and/or endocrine system. In various respects, the therapy device may include components configured for applying to a small body parts such as a wrist. In various embodiments, the body part to receive treatment is measured and the therapy device is fit to the patient based on the measurements. Thus, the therapy wrap is customized to the body part to be treated. The system may also include a plurality of wraps for different body parts and different sizes (e.g. small, medium, and large). Thus, a user can select a somewhat customized wrap depending on the application and patient. Aspects of the therapy wrap may be similar to the wrap disclosed by U.S. Patent Pub. No. 2001/0034546 A1 to Elkins, the entire contents of which is incorporated herein for all purposes by reference.

Exemplary device 30 includes a sleeve 33 and a therapy component, generally designated 35. In many respects, the exemplary device is configured similarly to the therapy wraps described above. The sleeve is formed of a compliant, flexible material such as nylon. The exemplary sleeve includes a pouch 36 with an opening 37 for receiving the therapy component (shown in FIG. 5C). The exemplary opening includes a zipper for sealing the therapy component inside the pouch.

The exemplary therapy component includes a bladder assembly positioned within a sleeve for delivering thermal therapy to a body part. The thermal therapy component is similar in various respects to the devices described in U.S. Pat. No. 7,837,638 to Miros et al. and U.S. Publication No. 2005/0256556 to Schirrmacher et al., the entire contents of which are incorporated herein for all purposes by reference.

Figure 6:
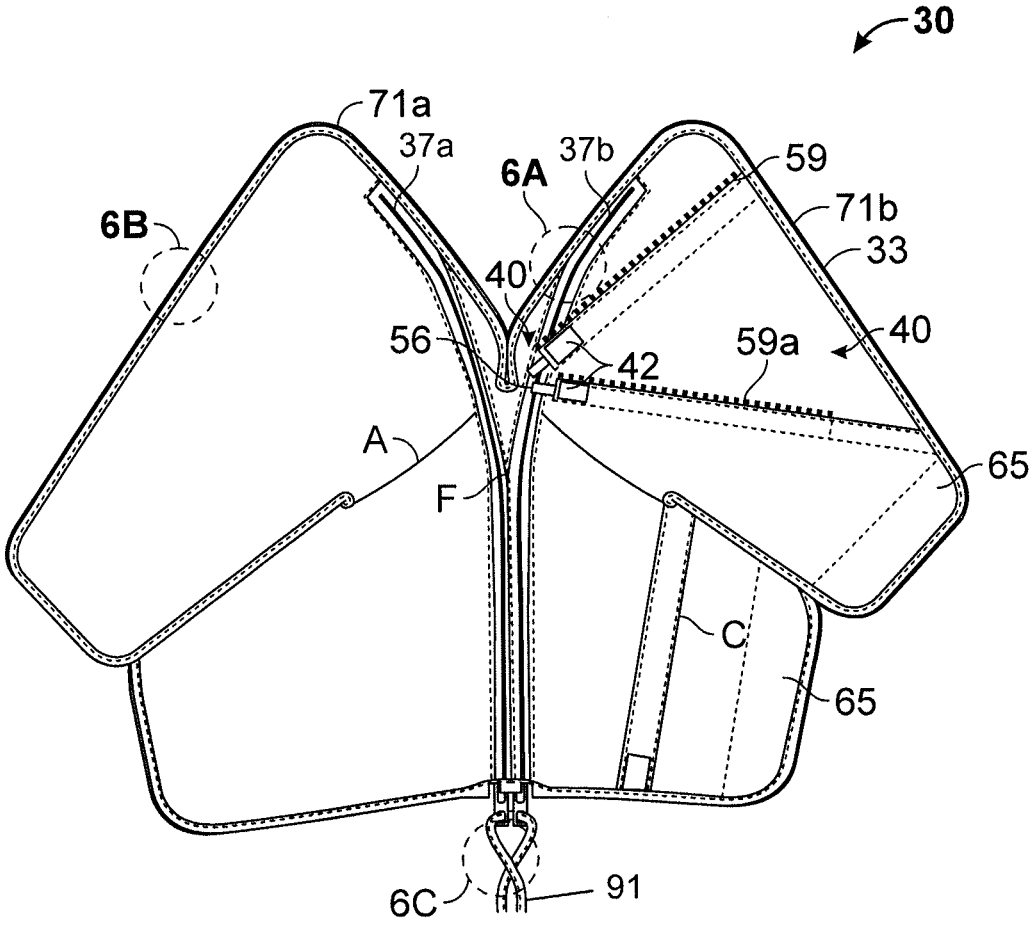
FIG. 6 is a top view of an outside surface of the therapy device of FIG. 1 in an open configuration.

With reference to FIG. 6, an exemplary sleeve includes two pouches and two respective openings 37*a* and 37*b*. The exemplary sleeve is generally symmetrical. The openings extend down the middle of the sleeve. The dual openings allow the therapy component to be more easily inserted into the complex sleeve shape in comparison to a single opening. The exemplary sleeve includes a single cord 91 for opening and closing the pouches. In an exemplary embodiment, the pouches are opened and closed with a zipper. In operation, a user can pull the single cord along the length of the sleeve to simultaneously open and close the pouches.

Referring to FIGS. 5A, 5B, 5C, 5D, 5E, and 9, the exemplary therapy component includes a multi-bladder assembly within sleeve 33. The assembly includes a fluid bladder 41 along a treatment side and gas pressure bladder 42 on an opposite side. The fluid bladder includes dots 15 for defining a fluid flowpath in the bladder. Some or all of the dots may extend through the assembly to define a corresponding flowpath in the gas pressure bladder. Further details regarding the therapy component will be provided below.

Exemplary sleeve 33 is formed as an outer layer to cover and/or protect the inner components. In various embodiments, the sleeve inner material layer is nylon and the outer material layer is loop material (e.g. pile). Suitable materials for the sleeve include, but are not limited to, nylon, spun bonded material (e.g. spun bonded polyethylene), hook and loop material, and more. In various embodiments, the therapy device does not include a sleeve. For example, the therapy component may be configured to operate in place of the sleeve. In various embodiments, the sleeve cover is configured to apply compression to a body part 34 (shown in FIG. 9). In various embodiments, the body part includes a joint 47 (shown in FIG. 12).

In various embodiments, sleeve 33, therapy component 35, or both comprises a moldable material such as a curable foam or resin. The foam may be molded to the body anatomy by applying the device snugly to the body and then curing the material. The device may include a pouch or bladder to be filled with expanding foam. When the device is applied to the body, the foam expands around the body part contour to improve conformance.

In various embodiments, therapy device 30 includes a structural layer comprising a rigid or semi-rigid structural member. The structural layer may be a rigid material such as ABS or metal. The structural member may be any conventional shape for imparting greater rigidity and strength to a selected portion of the therapy device in which it is positioned. In various embodiments, the structural member has a predefined shape corresponding to a body part to which the device is intended to be applied. In the exemplary case of an elbow, the structural member may have a predefined contour to improve conformance to the elbow at a predefined bent angle. In various embodiments, the sleeve includes a rigid structural material for protecting the inner therapy component.

In various embodiments, the therapy component is configured to promote bending of the joint. In one exemplary embodiment, the therapy component includes a fluid bladder having an upper bladder section, a lower bladder section, and a body section. The upper and lower bladder sections may include wings for aligning when the wrap is applied to the body part. The cover may include upper and lower sections including wings for aligning when the wrap is applied to the body part. The body section of the bladder and/or sleeve located between the upper and lower sections may include an opening for the joint, such as around a knee or elbow cap. The opening and alignment of the wings is configured to enable the joint wrap to be bent more easily. Further details regarding an example of a joint wrap for flexure is described in U.S. Pat. No. 7,837,638 to Miros et al, incorporated herein for all purposes by reference.

Referring to FIGS. 4, 4A, 4B, 6, 6A, 6B and 6C, exemplary sleeve 33 includes tabs or flaps 63 for applying the sleeve to the body. The tabs fold over the body part and fasten to a corresponding part of the sleeve. Each tab 63 includes a fastener 65. In various embodiments, the fastener is a hook portion for fastening to a corresponding loop portion on the sleeve. In various embodiments, the outer surface of the sleeve is covered with loop material to facilitate fastening of the sleeve. Suitable fasteners include mechanical fasteners, adhesives, magnets, and more. Examples of a mechanical fastener include, but are not limited to, a hook, a hook-and-loop fastener, a button, a clip, and a screw.

Figure 9:
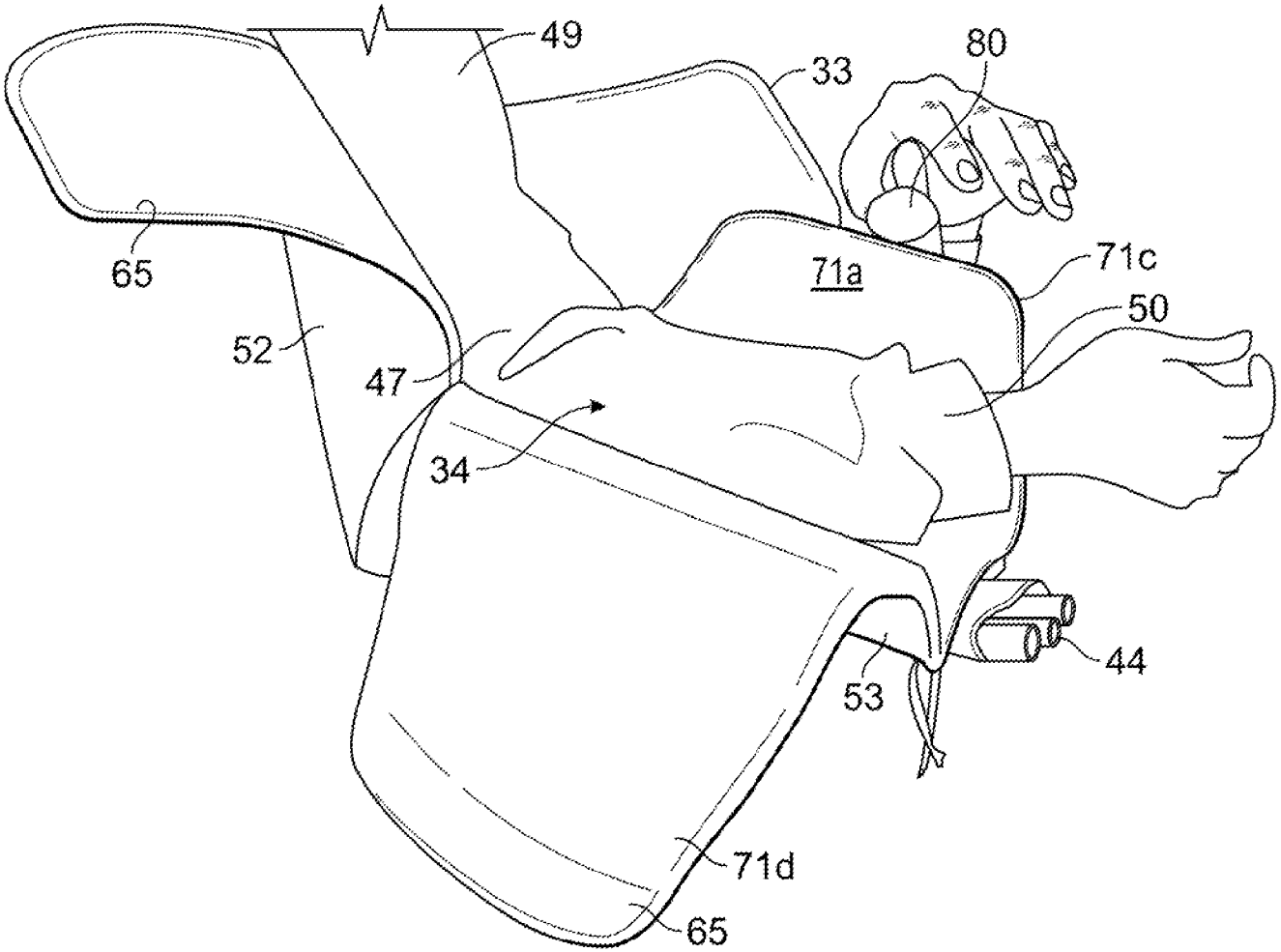
FIG. 9 is a perspective view of the device of FIG. 1, illustrating a method for applying the wrap to an elbow of a patient in accordance with aspects of the invention.
Figure 12:
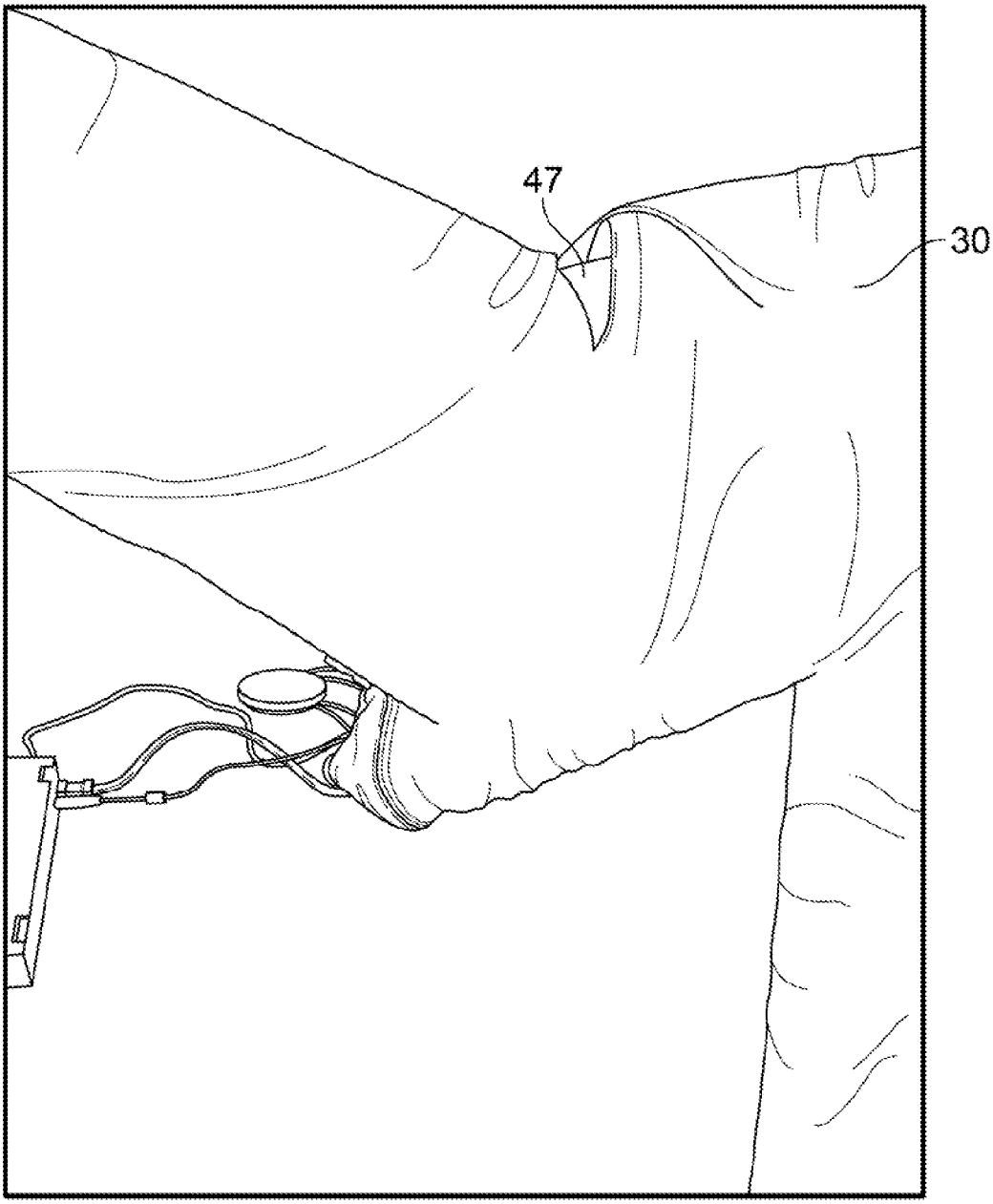
FIG. 12 is a perspective view of the device of FIG. 1 wrapped over an elbow and arm of a patient in accordance with aspects of the invention.

Exemplary sleeve 33 is sized to cover the target body part. In an illustrated embodiment, the body part includes an elbow and a portion of the arm adjacent the elbow such as portion of the radius bone and humerus bone. As shown in FIGS. 9 and 12, when the exemplary device is positioned on the body part, the sleeve covers an elbow joint (i.e. lower portion of the humerus) 47, a portion of the upper arm 49, and a portion of the lower forearm 50. In the case of a knee wrap, the sleeve may cover the patella and portions of the tibia, fibula, and femur.

With continued reference to FIGS. 4, 4A, 4B, 6, 6A, 6B and 6C, the sleeve may be sized to cover the entire joint. In various embodiments, the sleeve is sized to cover only a portion of the joint. The exemplary sleeve includes an upper portion 52 for positioning above the joint, a lower portion 53 for positioning below the joint, and a connecting region or portion 55 for connecting the upper and lower portions across the joint. In various embodiments, the sleeve includes only one of the upper portion and lower portion. In various embodiments, the sleeve does not cover any portion of the joint.

In various embodiments, when device 30 is applied to the body part, therapy component 35 is positioned to cover an upper portion of the body part, a lower portion, or both. It may be desirable to position the therapy component to limit or avoid positioning over the joint. In the case of an elbow, for example, the joint does not generally include tissue requiring heating, cooling, and/or compression therapy. It may also be uncomfortable for the user to receive therapy on the bone and cartilage. Accordingly, the device may be configured so the therapy component is not positioned on the joint during use. In various embodiments, as shown in FIG. 5*b*, the device includes separate therapy components for positioning in the upper and lower portions of the sleeve. In various embodiments, the portion of the sleeve positioned over the joint does not include any therapy component.

The portion of the sleeve positioned over the joint may include padding and other materials for patient comfort. The padding may include a foam, a cushion filled with gel or a fluid, an elastomer, and the like. The padding may be configured for protecting the body, for example, by including a shock-absorbing material.

In various embodiments, sleeve 33, fluid bladder 41, gas pressure bladder 42, or a combination of the same includes a cut-out. The cut-out may be positioned such that it aligns with the flexing point of the joint when the device is in position. For example, the cut-out may be positioned to align with the patella in the case of a knee wrap. The cut-out may have a shape and dimensions corresponding to the joint shape, which may be bent. For example, the cut-out may be elliptical to correspond to a bent elbow. The cut-out may be slightly oversized to accommodate even larger body parts and reduce the risk of pinching sides of the joint. A periphery of the cut-out may include padding and other components.

Exemplary device 30 is in the form of an elbow wrap. When ready for use, the exemplary sleeve has a predefined angle to promote conformance to an angle of the target body part.

As used herein, "predefined" generally refers to a characteristic or feature defined before operation and use, and in various respects, independent of use. Referring to FIG. 1, for example, the exemplary wrap is biased or predisposed to a specific angle even before it is applied to a body part.

The exemplary device has a selected, predefined angle that substantially corresponds to an angle formed by the body part to which the device is intended to be applied. In various embodiments, the predefined angle substantially corresponds to a desired angle of the body part during treatment.

Figure 2:
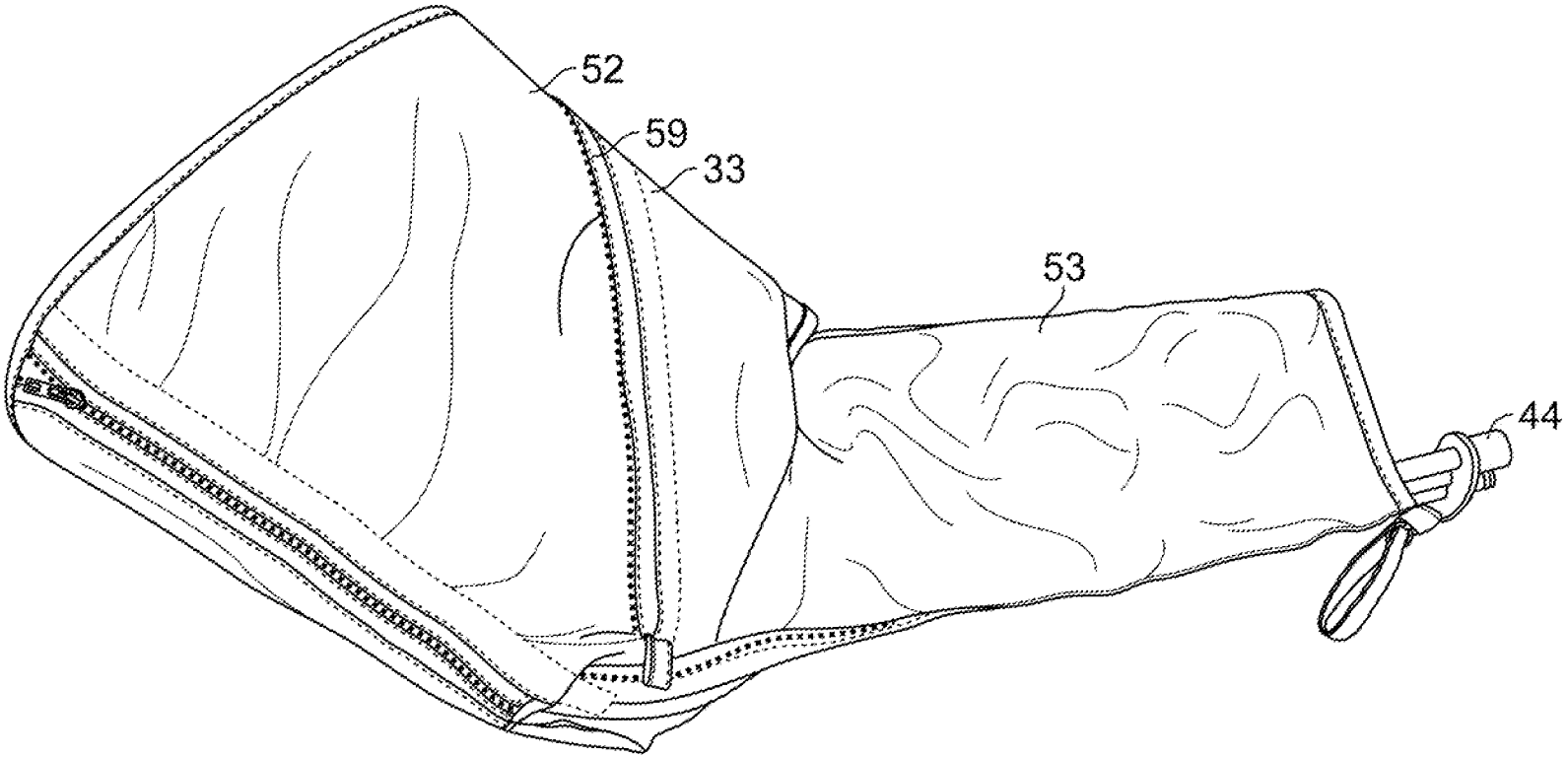
FIG. 2 is a front view of the therapy device of FIG. 1, illustrating the device after changing to a wider predefined angle setting.
Figure 3:
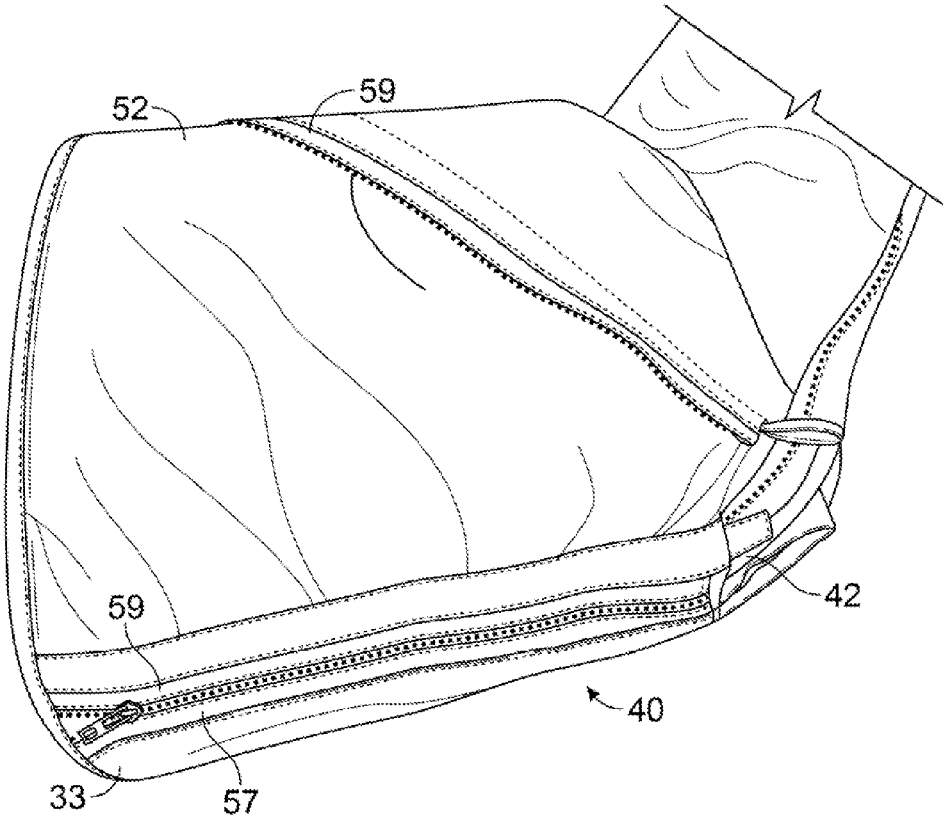
FIG. 3 is an enlarged view of the therapy device of FIG. 2, illustrating the angle adjustment assembly.
Figure 4:
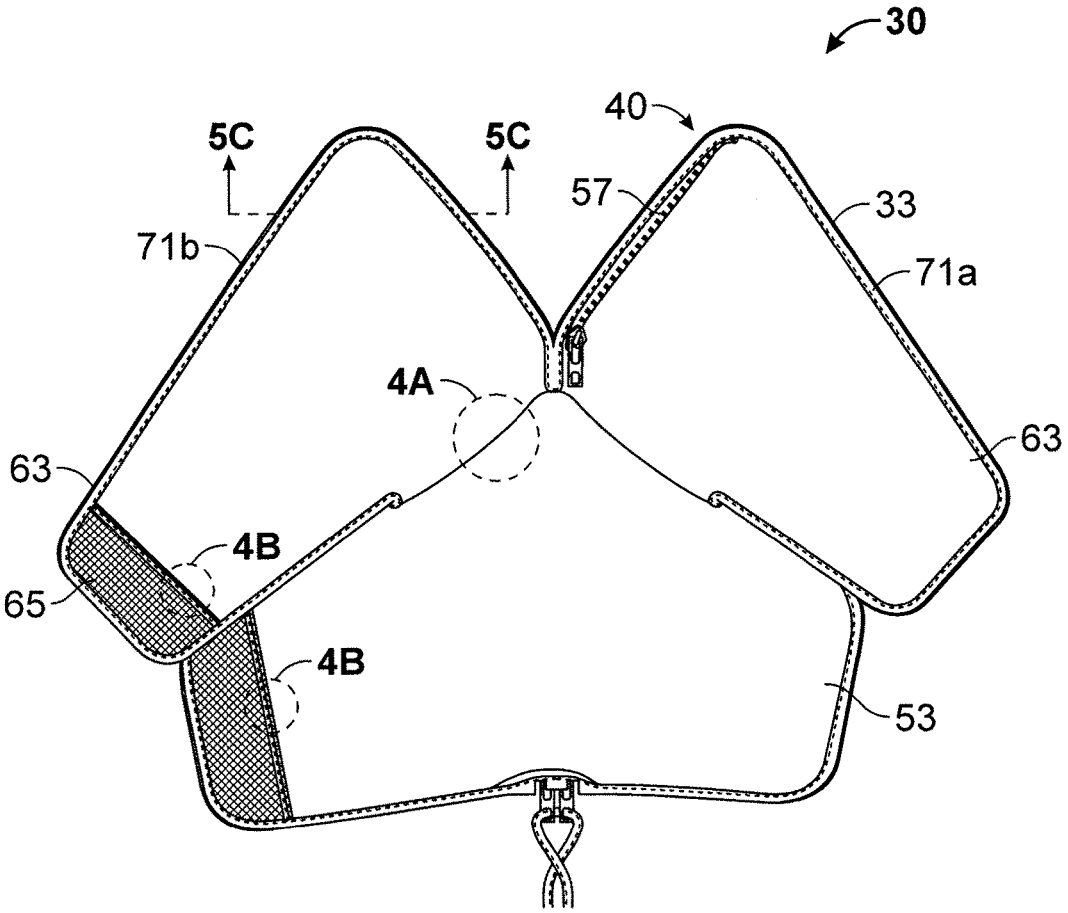
FIG. 4 is a top view of an inside treatment surface of the therapy device of FIG. 1 in an open configuration.

For example, therapy device 30 may be set to one of at least two predefined angles to align with an angle of the body part. FIG. 1 shows the exemplary wrap in a first setting with a first predefined angle. FIG. 2 shows the exemplary wrap in a second setting with a second first predefined angle. The second angle is different than the first angle. In various embodiments, the first angle is an acute angle. In various embodiments, the first angle is approximately 90 degrees. In various embodiments, the first angle is about 85 degrees. In various embodiments, the first angle is about 70 degrees, about 75 degrees, about 80 degrees, about 85 degrees, about 90 degrees, about 95 degrees, about 100 degrees, about 105 degrees, about 110 degrees, about 115 degrees, or about 120 degrees. In various embodiments, the second angle is about 135 degrees. In various embodiments, the second angle is about 180 degrees. In various embodiments, the second angle is an obtuse angle. In various embodiments, the second angle is about 115 degrees, about 120 degrees, about 125 degrees, about 130 degrees, about 135 degrees, about 140 degrees, about 145 degrees, about 150 degrees, about 155 degrees, about 160 degrees, or about 165 degrees.

Referring to FIGS. 4, 4A, 4B, 6, 6A, 6B, 6C, 7, and 8, the angular user settings are enabled by an angle adjustment assembly generally designated 40. The angle adjustment assembly allows a user to select a discrete and predefined angle for therapy device 30. In various embodiments, the device is configured to provide two, three, or more discrete angular user settings. The angle settings of the adjustment assembly may cover a range of angles in fixed increments, for example, 5 or 10-degree increments from 0 to 180 degrees.

Figure 7:
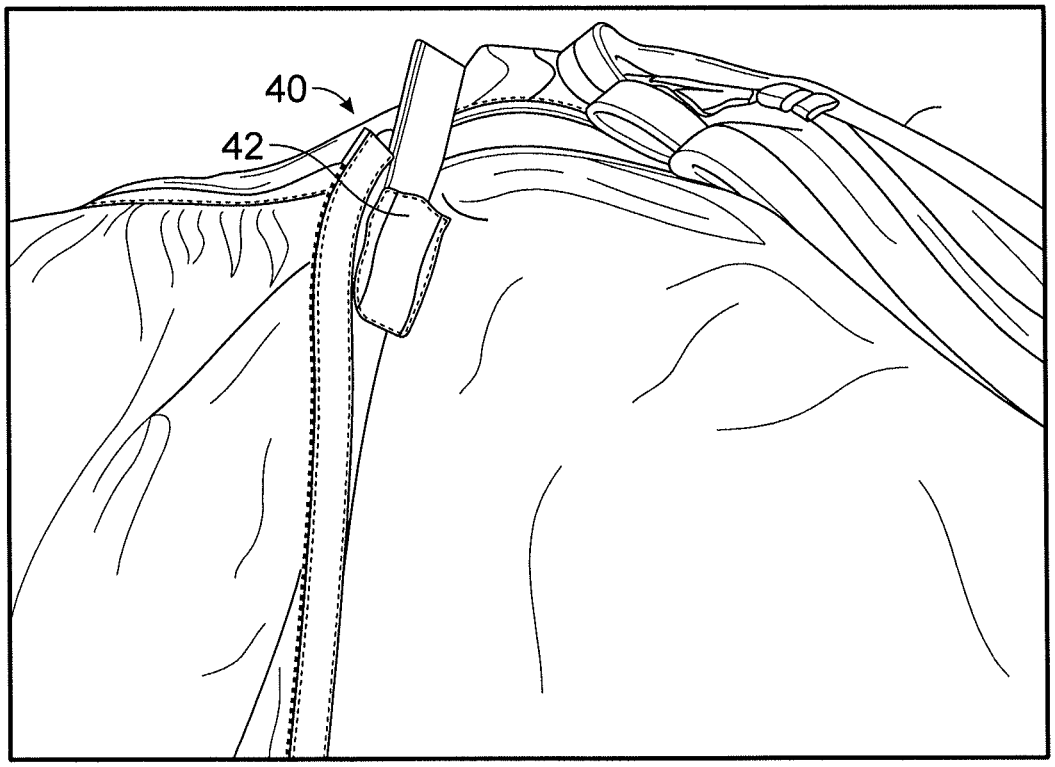
FIG. 7 is an enlarged view of a portion of the device of FIG. 1, illustrating a label for one of the male portions of the angle adjustment assembly.

The exemplary device includes labels 42 to identify adjustment assembly 40 to a user (shown, e.g., in FIGS. 1 and 7). Labels 42 also indicate to a user the resulting angle of the device for each setting. Because the exemplary device includes zippers for several components, the exemplary labels also serve to denote to the user the purpose of each zipper portion.

Exemplary angle adjustment assembly 40 includes a first adjustment portion 57 configured to fasten to a second adjustment portion 59. The exemplary angle adjustment assembly includes a plurality of second adjustment portions positioned at selected positions on sleeve 33. The second portions are spaced from one another at discrete locations to provide discrete adjustment settings. In various embodiments, the angle adjustment assembly is positioned entirely on side of the joint. For example, both the first portion and all the second portions may be positioned on sleeve upper portion 52.

One will appreciate that the location and angle of the angle adjustment assembly portions may be important. In an exemplary embodiment, the predefined angle is set, in part, but bringing a male portion into engagement with a female portion. The male and female portions are spaced apart when the wrap is in a flat configuration (e.g. FIG. 4). Accordingly, when the male and female portions are engaged, the sleeve effectively folds and changes shape. In particular, the material between the two portions folds along the inside of the sleeve. In various embodiments, the sleeve is configured to promote this folding action. For example, the material along the angle adjustment assembly may be preconfigured with bend lines to promote folding of the material in an accordion style. The material may be enclosed within a pocket to avoid the folded material from interfering with the body part and other sleeve components.

In an exemplary embodiment, the angle adjustment assembly is a zipper. The left and right-hand portions correspond to sides of the zipper. The therapy device includes a zipper pull tab 56 for assisting a user with zipping up the sleeve (shown, e.g., in FIG. 1). One will appreciate that the angle adjustment assembly may be formed of a variety of other attachment mechanisms.

Adjustment assembly 40 increases the operational flexibility of device 30. The exemplary device can be changed to different configurations simply and easily. There is no need for a user to select a different device when conditions change.

The ability to select particular angles is important in a number of settings. For example, patients recovering from surgery or an injury often have limited range of motion early in the recovery process. As recovery progresses, it may be desirable to change the angle of the body part. It may also be desirable to continuously change the angle of a body part during the recovery process, for example, to maintain range of motion (ROM) or reduce the risk of atrophy.

One will appreciate that the user settings may be selected based on the intended use of the device. Exemplary therapy device 30 is designed for patients recovering from ulnar collateral ligament (UCL) reconstruction (also known as "Tommy John surgery"). UCL reconstruction typically involves replacing a ligament in the elbow with a tendon from another part of the body (e.g. forearm, hamstring, knee, or foot). Patients recovering from UCL reconstruction typically receive cooling therapy and optionally compression therapy. It is desirable for post-UCL reconstruction patients to keep the elbow flexed at an upright position for one to two weeks following the surgery then straighten the arm in a second recovery period. In various embodiments, therapy device 30 includes an angular adjustment assembly 40 defining two or more user settings for the sleeve angle. A first setting is about 90 degrees. A second setting is about 135 degrees.

Immediately after surgery on a joint, patients often have limited ROM. To that end, angular adjustment assembly 40 may include a plurality of settings to allow the user to slow flex the joint to a greater degree. For example, the user may select a first setting with the joint nearly straight and then slowly increase the angle of flexure, or vice versa. Thus, the patient can easily and cost-effectively switch settings as ROM improves.

By contrast to conventional therapy devices and wraps, the exemplary device is adjustable and has a variety of settings and configurations. Accordingly, the device can be used throughout the recovery process. Conventional hot/cold wraps are either designed for a straight limb or a single angle for all applications. The set angle generally does not correspond to the intended use and operation. Wrapping the body part with ice packs also leads to performance problems. Ice packs also require the cumbersome task of wrapping and unwrapping the body part before and after each use.

The adjustment feature of the invention greatly improves the overall performance of the device. Besides improving the number of applications and operational flexibility of the device, the ability to select a discrete angle improves delivery of therapy. Improving alignment of the therapy device shape with the body part improves conformance to the body part, and accordingly performance.

In some cases, the body part to be treated may be immobilized. For example, the body part may be an arm in an immobilizing device such as a sling. The sling immobilizes the arm at a specific position and angle. The exemplary therapy device allows a user to customize the device shape based on the sling position and angle. Conventional devices, such as cold wraps, are biased to a set angle. Thus, the cold wrap and sling work against each other.

Although exemplary therapy device 30 fits snugly around a body part, the device generally allows a patient to continue to bend the joint with moderate freedom. One will appreciate from the description herein, however, that the device may be configured to adjust or modify the body part's freedom of motion. In various embodiments, therapy device 30 is configured to completely immobilize a body part. For example, the therapy device may include components to fix the position of the device, such as a sling. In various embodiments, therapy device 30 includes a rigid structural member for fixing the device at a desired position or angle. For example, the device may include an external brace. The device may also include a rigid structural layer integrated into the sleeve or therapy component to increase local bending strength or resist bending. The device may also be configured to stiffen and thus fix the body part angle when the gas pressure bladder is filled. For example, the gas pressure bladder may be configured to expand and fill the space in the sleeve so the body part has little or no room to move. In various embodiments, the sleeve seams and contours are positioned and configured to resist bending in one or more directions. Referring to the exemplary sleeve of FIG. 1, for example, an inner surface of the sleeve along the inner part of the elbow may be formed of a non-stretchable material.

Exemplary patient therapy device 30 is a flexible joint wrap including a sleeve for positioning a therapy component against a treatment area of a body. As discussed above, exemplary therapy component 35 is a thermal therapy device including a fluid bladder 41 for providing cooling therapy and a gas pressure bladder 42 for providing compressive therapy. The exemplary fluid bladder and gas pressure bladder are integrally formed in a multi-layer assembly. Suitable materials for the bladder assembly include, but are not limited to, thermoplastics such as polyvinyl chloride (PVC), poly(urethane) (PU), polyethylene (PE), polypropylene, copolymers, and more.

An optional manifold connector 44 (shown, e.g., in FIG. 9) connects the bladders in the interior of the pouch to one or more hoses and wires. The hoses and wires are connected at opposite ends to other components such as a power source, a controller, a fluid reservoir, and a gas source. The system may include a pump in fluid communication with a coolant source (not shown). The pump delivers heat transfer fluid from the coolant source to the fluid bladder through ports in the manifold connector. The manifold connector is similar in many respects to the three-port manifold connector disclosed by U.S. Pat. No. 6,871,878, the entire contents of which is incorporated herein for all purposes by reference. Other suitable manifold constructions are disclosed in U.S. Pat. Nos. 5,104,158 and 5,052,725, both to Meyer, et al. and both hereby incorporated herein for all purposes by reference. The system may also include valving for controlling the fluid flow. The exemplary system includes shut-off valves for opening and closing the fluid and/or gas lines to the therapy wraps. Some or all of these components may be embodied in a single control unit (not shown). Exemplars of such a control unit are disclosed in U.S. Patent Pub. Nos. 2010/0139294 to Lowe et al. and 2010/0145421 to Tomlinson et al., incorporated herein for all purposes by reference.

One will appreciate that other configurations may be applied to exemplary sleeve 33 and therapy component 35. For example, the fluid bladder surface facing the body part may include a coating. The device may include padding between the fluid bladder and the body part. It may be desirable to provide a thermal insulating layer between the fluid bladder and the body part. Similarly, a cut-out for allowing more direct contact with the fluid bladder may be desirable to increase heat exchange, such as if the body part corresponding to the cut-out includes thick areas of soft tissue. One will appreciate other features and variations of the therapy device for accommodating the shape of a body part based on the description herein.

In various embodiments, therapy component 35 is a bladder assembly including compliant fluid bladder 41 overlaid by gas pressure bladder 42. More specifically, the outer gas pressure bladder 42 is adapted to receive a first fluid such as a gas (e.g. air) that can be regulated to provide the desired amount of inflation of the bladder or pressure therein. This inflation or pressure affects the compressive force applied to the animate body during use. Inner fluid bladder 41 is adapted to receive a fluid, such as a coolant which can be in the form of a cold liquid, to transfer heat away from the animate body part. Alternatively, the fluid supplied to the inner bladder can have a temperature higher than the animate body part to heat the body part.

The exemplary fluid bladder and fluid flowpath defined therein is similar in many respects to the subject matter described in U.S. Pat. No. 7,198,093 to Elkins, U.S. Patent Pub. No. 2005/0256556 A1 to Schirrmacher et al., and U.S. application Ser. No. 12/982,266 to Lowe et al., the entire contents of which are incorporated herein for all purposes. In various embodiments, the fluid bladder is configured to direct the flow of fluid away from the bone of the joint.

In various embodiments, the pressure of gas furnished by the control unit to a gas pressure bladder is between about 0.25 psig and about 20 psig, preferably between about 0.25 psig and about 5 psig, and more preferably about 0.25 to about 1.5 psig. In various embodiments, the control unit maintains a compressive force of between about 0.25 psig and about 5 psig. In various embodiments, the control unit maintains a compressive force of between about 0.25 psig and about 0.5 psig. In various embodiments, the pressure of gas furnished by the control unit is user selectable in increments of 5 mm Hg from 0 mm to about 75 mm. In various embodiments, the device includes a plurality of gas pressure bladders, a first gas pressure bladder at a first pressure and a second gas pressure bladder at a second pressure different than the first.

Therapy device 30 may be in the form of a multi-layer assembly. Layers of therapy device may include, but are not limited to, a sleeve, a bladder, thermal insulation, padding, a structural member, fluidics, and electrical wiring. As shown in FIG. 5C, an exemplary therapy device includes a heat exchanger layer defined by a fluid bladder and a compressive layer defined by a compressive bladder. Both bladders are positioned within a pouch in a sleeve.

Although described as bladders, one will appreciate that other devices are suitable as heat exchangers and compressive devices. Suitable heat exchangers include, but are not limited to, thermoelectric devices, chemical cold packs, and more. Suitable compression devices include, but are not limited to, a spring tensioner, an overwrap layer, an elastomer, a belt or tie wrap, a shrink wrap, a hose-style clamp, and the like. The compression device may include conventional electromechanical devices such as a fabric that constricts in response to an electrical charge or a hose clamp and actuator. In various embodiments, the outer layer is formed of an elastic material to apply compression. Thus, any of the layers may be overlapping in function and position.

One will appreciate from the description herein that the therapy component may take the form of a variety of therapy devices other than a thermal therapy device. For example, the therapy component may be a device for administering electrical stimulation therapy. The therapy component may be a monitor such as a pulse oximeter. The therapy component may be a drug delivery device or device for delivery of intravenous fluids.

With reference to FIGS. 4-9, the method of using the patient therapy device in accordance with aspects of the invention will now be described. The therapy device in accordance with aspects of the invention is suitable for many uses. One will appreciate that the methods and systems of the invention may be configured for administering a variety of treatments to a patient in a variety of settings. Suitable treatment settings include, but are not limited to, an emergency medical setting, a clinic such as a rehabilitation or physical therapy clinic, an operating room (OR), a post-operative setting, a hospital, emergency medical care, and more. Suitable treatments include, but are not limited to, cooling therapy, heat therapy, compression therapy, and combinations of the same.

The method in accordance with aspects of the invention starts with preparing therapy device 30 for use. The therapy device is first assembled by positioning the therapy component in the sleeve. In an exemplary case of a multi-bladder therapy component, bladder assemblies 41 and 42 are inserted into pouch 36. A user pulls on cord 91 to open both opening 37*a* and 37*b* in sleeve 33. In an exemplary embodiment, a user selects a single bladder assembly having a shape corresponding to a shape of the sleeve. One side of the bladder is inserted through opening 37*a* and then the other side is inserted through opening 37*b*. The openings are then closed using cord 91. Alternatively, a user may select two separate bladder assemblies for positioning within each of the pouches.

Next, the device, in particular the sleeve, is formed into one of a plurality of predefined angles using angle adjustment assembly 40. A user determines which angular setting is appropriate based on the desired treatment, body part, or both. The exemplary angular adjustment assembly includes a left-hand or female portion 57 and two right-hand or male portions 59 (shown in FIGS. 4 and 5). The user selects the angle by zipping the female portion to one of the male portions. Labels 42 identify the resulting angle for each of the male portions (shown in FIG. 6).

Figure 8:
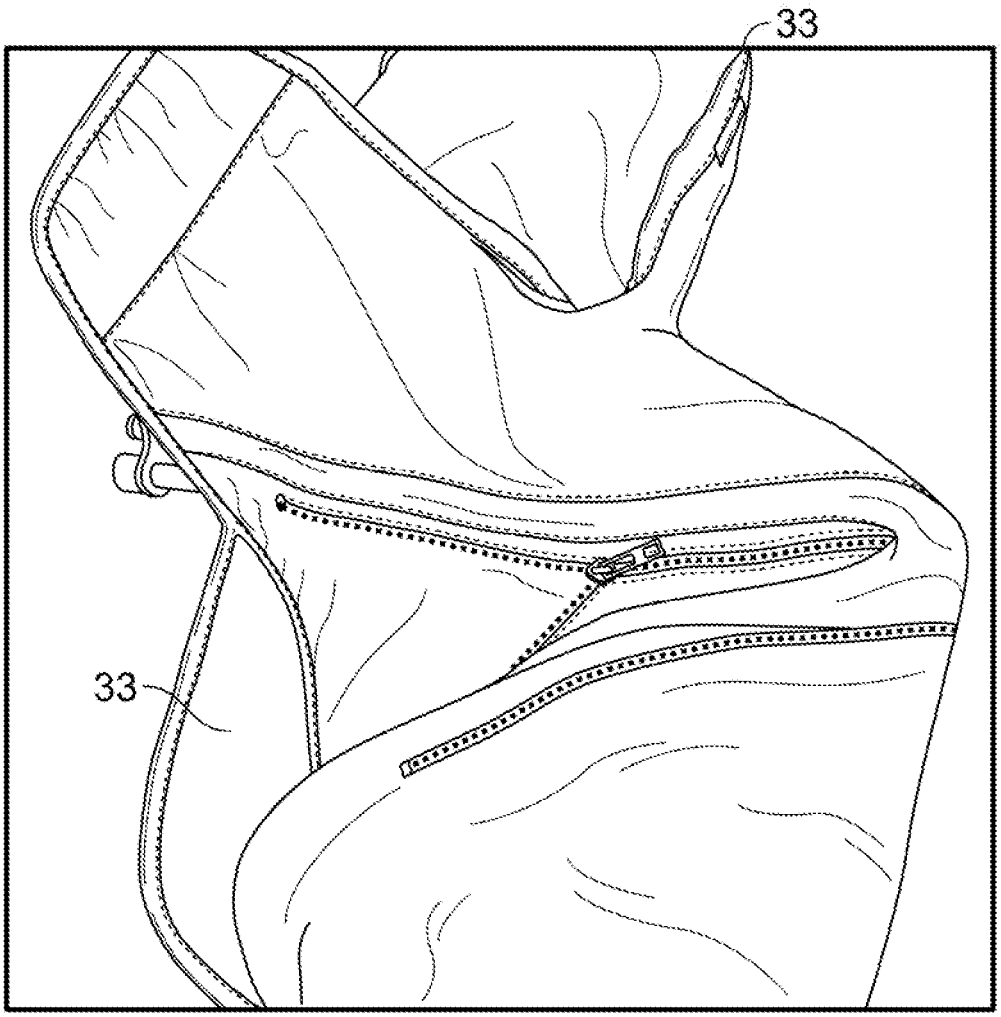
FIG. 8 is a front view of the device of FIG. 1 while the male and female portions of the angle adjustment assembly are being fastened together to define a predetermined angle.

The angle is set by pulling a first flap 71*a* of the sleeve towards a second flap 71*b* such that female portion 57 approaches the selected male portion 59*a*. The two portions are then fastened together as shown in FIG. 8. After the angle has been set, the wrap has a predefined angle generally corresponding to the body part to which it will be positioned as shown, for example, in FIG. 9.

FIGS. 9-12 illustrate wrapping of the prepared device to a body part. Although described in terms of an elbow, one will appreciate that the device and method of the invention applies equally to other body parts. Such body parts include, but are not limited to, parts of the body with a joint and parts with bent or complex contours. In various embodiments, the device is configured for use with an elbow, a knee, a wrist, an ankle, a hip, or a shoulder.

As shown in FIG. 9, a user positions body part 34 requiring treatment in therapy device 30. The body part is positioned such that it aligns with sleeve 33. Joint 47 is positioned within the crook formed by the predefined bend angle of the sleeve.

Next the device is fastened to the body part. Exemplary sleeve 33 includes flaps 71 having tabs 63 at the free ends. The free ends are pulled over the body part and the flaps are secured using fasteners 65 on the tab ends. Upper portion 52 and lower portion 53 of the device each have flaps for fastening to corresponding upper and lower portions of the arm, namely the upper arm and forearm.

The exemplary sleeve includes one flap on each side. A flap 71*c* is configured to be fastened over the body part in one direction and the other flap 71*d* is configured to pull over flap 7*k* in an opposite direction. Accordingly, flap 71*c* is referred to as an inner flap and the second flap 71*d* is referred to as an outer flap. In an illustrated embodiment, the inner flaps do not include fasteners. Instead, the inner flaps are held in place by the overlapping outer flaps.

As shown in FIG. 9, flaps 71 are fastened with one hand while the other arm is held in therapy device 30. Because the flaps are formed of flexible material, the flaps hang loose until they are fastened. Thus, the user must reach completely over body part 34 to reach the flap 71 on the opposite side of the body part. The flap closer to the free arm is reached more easily but has an awkward position. As shown in FIG. 9, for example, the user has to pull the flap in an awkward direction. Wrapping of the exemplary device to the body part is further complicated by the need to hold inner flap 71*c* is place while outer flap 71*d* is folded over and secured. The cumbersome process must also be repeated twice: once for the upper portion and once for the lower portion.

The exemplary therapy system includes an auxiliary fastening mechanism 80 for aiding a user with fastening of flaps 71. As such, the auxiliary fastening mechanism is sometimes referred to as a "helping hand."

Figure 10:
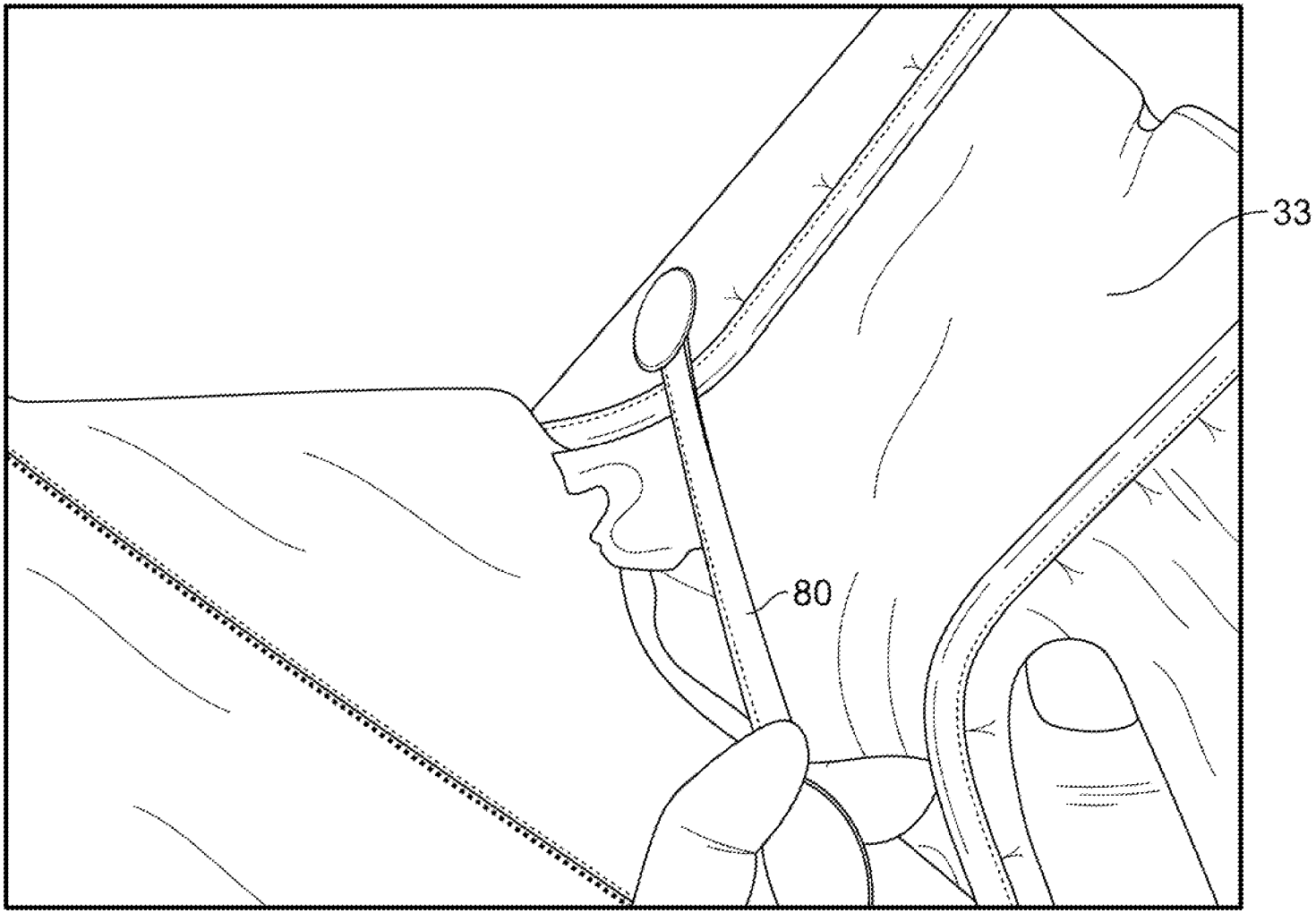
FIG. 10 is a perspective view of the device of FIG. 1 and an auxiliary fastening member, illustrating a user using the auxiliary fastening member to fasten an inner fastening flap.
Figure 11:
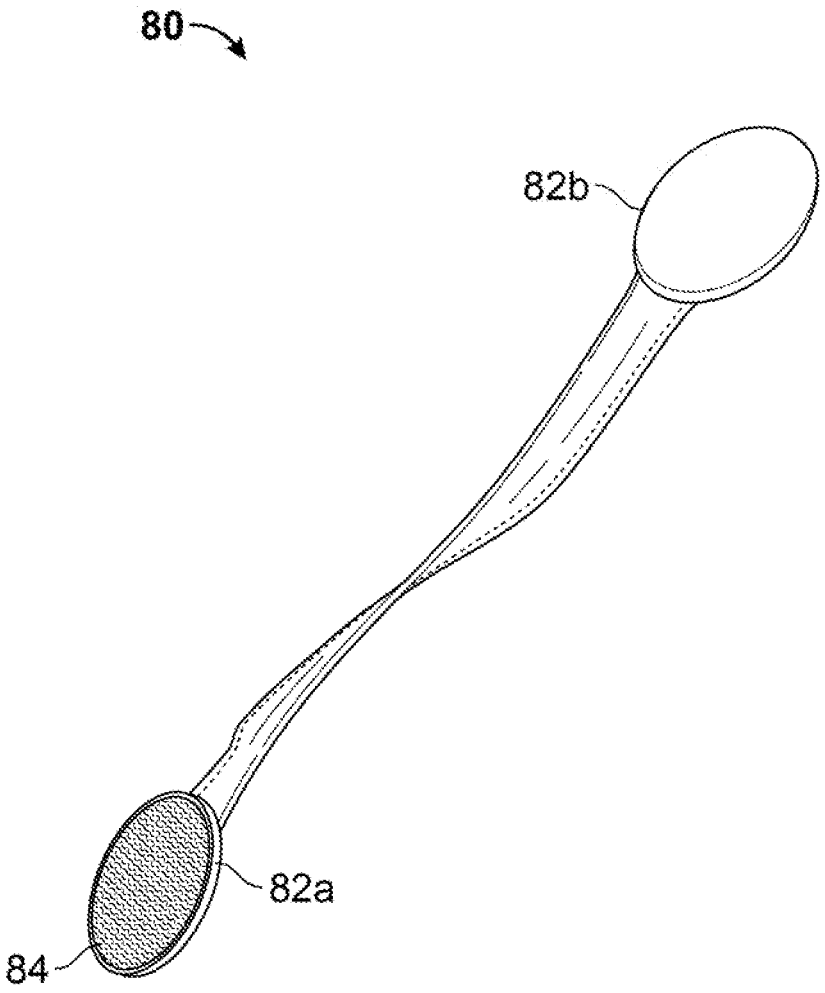
FIG. 11 is an enlarged view of the auxiliary fastening member of FIG. 10.

With reference to FIGS. 9-11, exemplary fastening mechanism 80 is generally elongate with two free ends 82. Each free end has a fastening device 84. The fastener at one end 82*a* is configured to secure to tab 71 and another fastener at an opposite end 82*b* for securing to a fastener receiver portion on the sleeve. In an exemplary embodiment, a portion of the inner surface of the sleeve is a loop portion and the fastening mechanism end has a hook portion, or vice versa. In an exemplary embodiment, the fastener is a hook portion and the outer surface of the flap is a loop portion, or vice versa.

In various embodiments, the fastening mechanism 80 includes a body and separate end portions. The body may be configured to stretch. The ends may be configured to be relative rigid to aid in fastening. The mechanism may include a backing for the fastener. The backing may be relatively rigid. In various embodiments, the backing includes a logo or printed information. The body may be an elastomer. Suitable materials for the body include, but are not limited to, nylon, rubber such as ethylene propylene diene monomer M-class (EPDM), and a thermoplastic elastomer (TPE) such as Santoprene®. Suitable materials for the ends include, but are not limited to, a thermoplastic such as acrylonitrile butadiene styrene (ABS) or high density polyethylene, polypropylene, and polycarbonate.

In practice, the user grabs one end 82*a* of the helping hand to a respective inner flap 71*a* and pulls the flap over the body part (shown, e.g., in FIG. 10). The flap is then temporarily held in place by fastening the opposite end of the helping hand to the sleeve. With the inner flap held in place, the user can easily pull over the outer flap thereby more permanently securing the inner flap. The exemplary system includes two helping hands, one for each of the upper portion and lower portion of the device.

Turning to FIG. 12, once therapy device 30 is applied to body part 34, the device is connected to the respective operational components. In an exemplary embodiment, manifold connector 44 is connected to a control unit (not shown). Thereafter the system is turned on so fluid flows to the fluid bladder and gas (e.g. air) is pumped to the gas pressure bladder in accordance with treatment protocol.

Therapy device 30 is configured to conform to the body part to which it is applied. The exemplary therapy device provides little or no support for the body part. With the exemplary elbow wrap, a user rests the elbow on the body while in a reclined position. Alternatively, the elbow wrap may be used with a sling. A sling or other immobilizing device may be attached to the arm in an otherwise conventional manner. As described above, the therapy device may also be configured to immobilize the body part. In various embodiments, the therapy device includes an integrated immobilization component.

After treatment is complete, device 30 is disconnected from the control unit (not shown) using manifold 44 and the device is removed from body part 34. When the therapy device is used again, the user repeats the steps above. The therapy device can be adjusted to a different predefined angle based on the new user, new treatment, or both.

In some cases treatment may be administered in stages requiring different device configurations. In this case, the device is removed when the first treatment is complete. The user then changes the angle of the device to another predefined angle based on the second treatment settings. In an exemplary embodiment, the first treatment calls for selecting a first angle and the second treatment calls for a second angle. The second angle may be different than the first angle. In various embodiments, the first angle is about 135 degrees and the second angle is about 90 degrees.

After the user adjusts the angular settings of device 30 using angle adjustment assembly 40, the device is reconnected to the control unit. The device is then operated under the second treatment settings. This process can be repeated for additional treatment settings.

One of skill in the art will appreciate that a number of other features and modifications are within the scope of the invention. Variations and modifications of any of the devices and methods disclosed herein will be readily apparent to persons skilled in the art. As such, it should be understood that the foregoing detailed description and the accompanying illustrations, are made for purposes of clarity and understanding, and are not intended to limit the scope of the invention, which is defined by the claims appended hereto. Any feature described in any one embodiment described herein can be combined with any other feature of any of the other embodiment whether preferred or not.

For convenience in explanation and accurate definition in the appended claims, the terms "up" or "upper", "down" or "lower", "inside" and "outside" are used to describe features of the present invention with reference to the positions of such features as displayed in the figures.

In many respects the modifications of the various figures resemble those of preceding modifications and the same reference numerals followed by apostrophes or subscripts "a", "b", "c", and "d" designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A device for providing treatment to a body part, the device comprising:

a therapy component for applying thermal therapy, compression therapy, or both;

a sleeve for removably receiving the therapy component and sized to cover an anatomical hinge joint and an adjacent body part when the sleeve is positioned on a body; and an adjustment assembly for adjusting an angle of the sleeve to conform to the hinge joint, wherein the adjustment assembly is integral and permanently affixed to the sleeve, wherein the adjustment assembly comprises a first adjustment portion configured to fasten to a plurality of second adjustment portions, wherein the adjustment assembly is configured to allow adjustment of the sleeve to one of a plurality of discrete, predetermined angles by fastening the first adjustment portion to one of the second adjustment portions, wherein the first adjustment portion comprises a first half of a zipper and the plurality of second adjustment portions comprises a plurality of second halves of a zipper that are each complementary to the first half.

2. The device of claim 1, wherein the adjustment assembly is formed on the sleeve.

3. The device of claim 1, wherein the therapy component comprises a fluid bladder.

4. The device of claim 3, wherein the bladder is configured to circulate a heat transfer fluid to transfer heat between the therapy component and the body part.

5. The device of claim 3, wherein the bladder is a gas pressure bladder for applying a compressive force to the body part.

6. The device of claim 3, wherein the fluid bladder is configured for circulating a heated or cooled fluid, and wherein the therapy component further comprises a gas pressure bladder for applying a compressive force, the fluid bladder having a treatment side and the gas pressure bladder being positioned on an opposite side of the fluid bladder as the treatment side.

7. The device of claim 1, wherein the sleeve is sized to cover the hinge joint, an upper portion of the body above the joint, and a lower portion of the body below the hinge joint.

8. The device of claim 7, wherein the therapy component is positioned to cover the upper portion, the lower portion, or both when the device is positioned on the body.

9. The device of claim 7, wherein the therapy component does not extend over the hinge joint when the device is positioned on the body.

10. The device of claim 1, wherein the adjustment assembly comprises an attachment mechanism configured to attach a first portion of the sleeve to a second portion or a third portion of the sleeve.

11. The device of claim 10, wherein the adjustment assembly is flexible.

12. A medical device for a mammalian body part, comprising:

a sleeve sized and configured to extend over an anatomical hinge joint, an upper portion of the body above the anatomical hinge joint, and a lower portion of the body below the anatomical hinge joint; and an adjustment assembly configured to provide adjustment of an angle of the sleeve;

wherein the adjustment assembly is configured to be positioned entirely on one of the lower portion or the upper portion;

wherein the adjustment assembly comprises a first adjustment portion configured to fasten to a plurality of second adjustment portions, wherein the adjustment assembly is configured to allow adjustment of the sleeve to one of a plurality of discrete, predetermined angles by fastening the first adjustment portion to one of the second adjustment portions, wherein the first adjustment portion comprises a first half of a zipper and the plurality of second adjustment portions comprises a plurality of second halves of a zipper that are each complementary to the first half.

13. The device of claim 12, wherein the anatomical hinge joint is an elbow and the sleeve is sized to extend over at least portions of an upper arm and a forearm.

14. The device of claim 13, wherein the adjustment assembly is positioned entirely on a portion of the sleeve configured to extend over the upper portion of the body above the anatomical hinge joint.

15. The device of claim 12, wherein the sleeve is configured to attach to the lower portion and upper portion.

16. The device of claim 12, wherein the sleeve includes a cut-out for at least a portion of the anatomical joint.

17. The device of claim 12, further comprising a therapy component for positioning against the upper portion, the lower portion, or both using the sleeve.

18. The device of claim 17, wherein the therapy component is a thermal therapy wrap.

19. A device for providing treatment to a body part requiring treatment, the device comprising:

a sleeve sized to conform to a body part including an anatomical hinge joint, the sleeve including a pouch adapted to receive a therapy component, an upper portion corresponding to one side of the hinge joint, and a lower portion corresponding to an opposite side of the hinge joint when the sleeve is positioned on the body part; and an angle adjustment assembly for adjusting an angle of the sleeve and formed on the upper portion or lower portion of the sleeve, the angle adjustment assembly comprising a first adjustment portion configured to fasten to a plurality of second adjustment portions, wherein the plurality of second portions are spaced from one another at discrete locations, wherein the angle adjustment assembly is integral and permanently affixed to the sleeve, wherein the adjustment assembly is configured to allow adjustment of the sleeve to one of a plurality of discrete, predetermined angles by fastening the first adjustment portion to one of the second adjustment portions, wherein the first adjustment portion comprises a first half of a zipper and the plurality of second adjustment portions comprises a plurality of second halves of a zipper that are each complementary to the first half.

20. The device of claim 19, further comprising a therapy component secured within the sleeve pouch, the therapy component including a heat transfer device adapted to transfer heat between the device and the body part.

21. The device of claim 20, wherein the heat transfer device comprises an inflatable bladder for applying a compressive force to the body part.

22. A method for providing treatment to a patient, the method comprising steps of:

preparing a medical device for administering treatment to a body part including a hinge joint of a patient, the device comprising a therapy component and a sleeve for applying the therapy component to the body part, wherein the sleeve is formed into one of a plurality of predefined angles, wherein the sleeve comprises an angle adjustment assembly including a first adjustment portion configured to fasten to a plurality of second adjustment portions, the plurality of second portions being spaced from one another at discrete locations, wherein the angle adjustment assembly is integral and permanently affixed to the sleeve, wherein the adjustment assembly is configured to allow adjustment of the sleeve to one of a plurality of discrete, predetermined angles by fastening the first adjustment portion to one of the second adjustment portions, wherein the first adjustment portion comprises a first half of a zipper and the plurality of second adjustment portions comprises a plurality of second halves of a zipper that are each complementary to the first half;

applying the medical device to the body part; and administering a first treatment to the body part using the medical device.

23. The method of claim 22, further comprising steps of:

removing the medical device from the body part;

changing an angle of the sleeve from the one angle to another angle among the plurality of predefined angles; and re-applying the medical device to the body part.

24. The method of claim 23, wherein the one predefined angle is based on the first treatment.

25. The method of claim 23, further comprising a step of administering a second treatment to the body part after changing the angle of the sleeve.

26. The method of claim 25, wherein the another predefined angle is based on the second treatment.

27. The method of claim 22, wherein the step of administering treatment comprises treatment for recovery after ulnar collateral ligament (UCL) reconstruction surgery.

28. The method of claim 22, wherein the step of administering treatment comprises temperature-controlled therapy, compression therapy, or both.

29. The method of claim 22, wherein the medical device is prepared by fastening the first adjustment portion to one of the plurality of second adjustment portions.

* * * * *